US008418893B2

(12) United States Patent
Mizobe et al.

(10) Patent No.: US 8,418,893 B2
(45) Date of Patent: Apr. 16, 2013

(54) IMMERSION NOZZLE

(75) Inventors: Arito Mizobe, Fukuoka (JP); Kouichi Tachikawa, Fukuoka (JP)

(73) Assignee: Krosakiharima Corporation, Fukuoka (JP)

( * ) Notice: Subject to any disclaimer, the term of this patent is extended or adjusted under 35 U.S.C. 154(b) by 378 days.

(21) Appl. No.: 12/797,947

(22) Filed: Jun. 10, 2010

(65) Prior Publication Data

US 2011/0240688 A1 Oct. 6, 2011

(30) Foreign Application Priority Data

Mar. 31, 2010 (JP) ..... 2010-084226

(51) Int. Cl.
*B22D 41/08* (2006.01)

(52) U.S. Cl.
USPC ..... 222/606; 222/594

(58) Field of Classification Search ..... 222/591, 222/594, 606, 607; 266/236; 164/488, 437
See application file for complete search history.

(56) References Cited

U.S. PATENT DOCUMENTS

| | | | | |
|---|---|---|---|---|
| 6,016,941 | A * | 1/2000 | Damle | 222/606 |
| 2007/0158884 | A1* | 7/2007 | Tsukaguchi | 266/236 |

FOREIGN PATENT DOCUMENTS

| | | | |
|---|---|---|---|
| JP | 4134251 | U | 12/1992 |
| JP | 11291026 | A | 10/1999 |
| JP | 2004209512 | A | 7/2004 |

* cited by examiner

*Primary Examiner* — Scott Kastler
*Assistant Examiner* — Michael Aboagye
(74) *Attorney, Agent, or Firm* — Marty Fleit; Paul D. Bianco; Fleit Gibbons Gutman Bongini Bianco PL

(57) ABSTRACT

It is intended to uniform and straighten a molten steel stream flowing out of a discharge port of an immersion nozzle, and thus suppress mold powder entrapment in the vicinity of the immersion nozzle. The immersion nozzle comprises a tubular-shaped straight nozzle body formed to extend in a vertical longitudinal direction and adapted to allow molten steel from a molten-steel inlet provided at an upper end thereof to pass downwardly therethrough, and a pair of discharge ports provided in a lower portion of the straight nozzle body in bilaterally symmetrical relation and adapted to discharge the molten steel from a lateral surface of the straight nozzle body in a lateral direction. An inner surface of each of the discharge ports has, at least in part or in its entirety, a shape defined by a curved line along which an inner bore of the discharge port in a longitudinal cross-section of the immersion nozzle passing through respective centers of the immersion nozzle and the discharge port is gradually reduced in diameter in a direction from a start position to an end of the discharge port, wherein the curved line is represented by a diameter in the longitudinal cross-section of the immersion nozzle.

9 Claims, 22 Drawing Sheets

IMMERSION NOZZLE

TECHNICAL FIELD

The present invention relates to a continuous casting immersion nozzle for pouring molten steel into a mold, and more particularly to a configuration of a discharge port thereof.

BACKGROUND ART

In continuous casting of molten steel, a flow state of molten steel in a mold for receiving molten steel has a great impact steel quality. Thus, it is an important technical matter for a continuous casting operation to control the flow state in connection with a structure of an immersion nozzle having a direct impact on the flow state.

A configuration of an inner bore of the immersion nozzle, particularly, a configuration of a discharge port of the immersion nozzle, has a great impact on a state of a molten steel stream.

Depending on a state of a molten steel stream from the discharge port, a flow state of molten steel in a mold (in-mold molten steel) becomes unstable due to episodic occurrence of turbulences therein, such as reversed flows in various regions in the mold and locally deflected flows which frequently change with time, and resulting fluctuation ("wave", "heave", "change in flow direction") in a molten steel surface, to cause difficulty in allowing inclusions to sufficiently float up around an edge of a slab and in allowing a mold powder to be uniformly transferred onto a surface of the slab, which leads to non-uniform entrapment/incorporation of the mold powder and the inclusions into the slab.

Moreover, there arises another problem, such as difficulty in obtaining a temperature distribution of in-mold molten steel requited for or optimal to formation of a shell during a course of solidification of the molten steel. These exert a negative impact on slab quality and increase a risk of occurrence of a breakout, etc.

As a prerequisite to solving such problems, it is necessary to take measures, such as maximally uniforming a flow velocity, and preventing occurrence of a deflected flow. However, even if a configuration of the discharge port, such as an angle and an area thereof, is simply adjusted, a stable molten steel stream free of mold powder entrapment cannot be obtained As measures for the above problems, it has been tried to set an angle of a discharge port of an immersion nozzle in an upward direction so as to allow a molten steel stream flowing out of the discharge port of the immersion nozzle to provide a flow in the vicinity of a molten steel surface even at a position adjacent to a periphery of a mold. However, even if an angle of a discharge port formed in a part of a wall of a straight nozzle body is changed within the range of a wall thickness of the straight nozzle body, a sufficiently stable flow cannot be obtained.

For example, as means for controlling a molten steel stream, the following Patent Document 1 proposes an immersion nozzle comprising a discharge port formed in a semicircular shape having a lower region which is a chord equal to an inner diameter of a cylindrical tube, and an upper region which is an arc equal to one-half of an inner circumference of the cylindrical tube. However, even if the discharge port is simply formed in a circular (semicircular) shape or the like in cross-section against a molten-steel outflow direction as in the Patent Document 1, turbulences in a molten steel stream during discharge from the discharge port and non-uniformity in velocity in the cross-section cannot be solved. Thus, the aforementioned various problems, such as mold powder entrapment, still cannot be solved.

The following Patent Document 2 proposes to form a discharge port of an immersion nozzle into a horizontally-long rectangular shape, and set a horizontal-to-vertical ratio of the rectangular shape in the range of 1.01 to 1.20. However, even if the discharge port is simply formed in a rectangular shape in cross-section against a molten-steel outflow direction, or a horizontal-to-vertical ratio of the rectangular shape is simply set in a specific range, turbulences in a molten steel stream during discharge from the discharge port and non-uniformity in velocity in the cross-section cannot be solved. Thus, the aforementioned various problems, such as mold powder entrapment, still cannot be solved.

The following Patent Document 3 discloses a molten steel-introducing submerged entry nozzle for preventing pencil type defects in a casting product, wherein a central bore communicating with an exit port (discharge port) terminates at an upwardly dish-shaped bottom surface which extends to a periphery of a nozzle structure and forms a lower surface region of the exit port, whereby molten steel flowing across the upwardly dish-shaped bottom surface is directed outwardly and upwardly from the nozzle structure, and a submerged entry nozzle (synonymous with "immersion nozzle") designed such that the exit port has an upper region partially defined by a downwardly slanted lip, whereby a flow of molten steel across the lip is directed outwardly and downwardly into an exit flow of molten steel along the upwardly dish-shaped bottom surface. However, in the Patent Document 3, it is intended to concentrate a molten steel stream in a specific direction, with a view to eliminating retention of argon gas, etc. Thus, it cannot be expected to obtain an effect of uniforming and straightening a molten steel stream flowing out of the discharge port to solve the various problems, such as mold powder entrapment.

PRIOR ART DOCUMENTS

Patent Documents

[Patent Document 1] JP-U 4-134251A
[Patent Document 2] JP 2004-209512A
[Patent Document 3] JP 11-291026A

DISCLOSURE OF THE INVENTION

Problem to be Solved by the Invention

It is an object of the present invention to uniform and straighten a molten steel stream flowing out of a discharge port of an immersion nozzle, and thus suppress mold powder entrapment, etc., in the vicinity of the immersion nozzle.

Means for Solving the Problem

The present invention is based on new knowledge of the inventors that, in a continuous casting where molten steel is poured into a molten-steel continuous casting mold, entrapment of a mold powder into molten steel in the vicinity of the immersion nozzle is greatly affected by a phenomenon that a molten steel stream flowing out of a discharge port of an immersion nozzle is non-uniform at a molten-steel discharge position, i.e., at an outer end of the discharge port on an outer peripheral surface of the immersion nozzle, and the mold powder entrapment is highly likely to occur when a velocity distribution width in an upward-downward direction in the mold, particularly, in the vicinity of a top surface of molten steel, is relatively large due to the above discharge flow.

As a prerequisite to suppress or reduce the mold powder entrapment into molten steel in the above knowledge, it is necessary to uniform a molten steel stream flowing out of a discharge port of an immersion nozzle. This uniformity can be evaluated by a velocity having elements consisting of a speed and a direction of a molten steel stream (the velocity will hereinafter be referred to simply as "molten steel flow velocity").

Based on knowledge about hydrodynamics and through computer software-based simulation and various verifications in an actual casting operation in regard to a nozzle shape and others and behavior of a molten steel stream in continuous casting, the inventors have found that the above object can be achieved by forming a discharge port of an immersion nozzle into the following specific shape/configuration.

Specifically, the present invention is an immersion nozzle having the following first to fourth features.

As a first solution, the present invention provides an immersion nozzle which comprises a tubular-shaped straight nozzle body formed to extend in a vertical longitudinal direction and adapted to allow molten steel from a molten-steel inlet provided at an upper end thereof to pass downwardly therethrough, and a pair of discharge ports provided in a lower portion of the straight nozzle body in bilaterally symmetrical relation and adapted to discharge the molten steel from a lateral surface of the straight nozzle body in a lateral direction, wherein an inner surface of each of the discharge ports has, at least in part or in its entirety, a shape defined by a curved line along which an inner bore of the discharge port in a longitudinal cross-section of the immersion nozzle passing through respective centers of the immersion nozzle and the discharge port is gradually reduced in diameter in a direction from a start position to an end of the discharge port, and wherein the curved line is represented by a diameter Dz in the longitudinal cross-section of the immersion nozzle in the following formula 1:

$$Dz = \left(\frac{H+L}{H+Z}\right)^{\frac{1}{n}} \times Do \tag{1}$$

where: L is a wall thickness of the immersion nozzle; Di is a diameter of the discharge port at the start position of the discharge port (a boundary position between the discharge port and an inner bore wall of the immersion nozzle; the same applies to the following formula 2); Do is a diameter of the discharge port at the end of the discharge port (a boundary position between the discharge port and an outer peripheral wall of the immersion nozzle; the same applies to the following formula 2); Z is a distance between the start position of the discharge port, and an arbitrary position apart from the start position toward the end of the discharge port; Dz is a diameter of the discharge port at the position Z in the longitudinal cross-section of the immersion nozzle; and H is represented by the following formula 2, $$H = \frac{L}{\left\{\left(\frac{Di}{Do}\right)^{n} - 1\right\}}, \tag{2}$$

where $\frac{Di}{Do} \geq 1.6$, and $n \geq 1.5$

As a second solution, in the immersion nozzle as the first solution, each of the discharge ports has an angle in the longitudinal direction of the immersion nozzle, except an angle toward a direction perpendicular to a longitudinal axis of the immersion nozzle, wherein the inner bore of the discharge port with the angle is configured such that a position of the discharge port corresponding to the distance Z in the longitudinal cross-section of the immersion nozzle is gradually shifted in a direction parallel to the longitudinal axis of the immersion nozzle by a longitudinal distance depending on the angle at the position corresponding to the distance Z.

As a third solution, the present invention provides an immersion nozzle which comprises a tubular-shaped straight nozzle body formed to extend in a vertical longitudinal direction and adapted to allow molten steel from a molten-steel inlet provided at an upper end thereof to pass downwardly therethrough, and a pair of discharge ports provided in a lower portion of the straight nozzle body in bilaterally symmetrical relation and adapted to discharge the molten steel from a lateral surface of the straight nozzle body in a lateral direction, wherein at least a part or an entirety of an inner surface of each of the discharge ports is defined by a combination of a plurality of curved lines each of which causes a diameter of an inner bore of the discharge port in a longitudinal cross-section of the immersion nozzle taken along a plane passing a center line of the immersion nozzle and a center line of the discharge port to gradually decrease in a direction from a start position to an end of the discharge port, and wherein each of the curved lines is configured to satisfy the formula 1 as defined in claim 1, while setting n in the formula 1 to a different value.

As a fourth solution, in the immersion nozzle as the third solution, each of the discharge ports has an angle in the longitudinal direction of the immersion nozzle, except an angle toward a direction perpendicular to a longitudinal axis of the immersion nozzle, and wherein the inner bore of the discharge port with the angle is configured such that a position of the discharge port corresponding to the distance Z in the longitudinal cross-section of the immersion nozzle is gradually shifted in a direction parallel to the longitudinal axis of the immersion nozzle by a longitudinal distance depending on the angle at the position corresponding to the distance Z.

Effect of the Invention

The immersion nozzle of the present invention can uniform a molten steel stream flowing out of each of the discharge ports.

Thus, it becomes possible to suppress mold powder entrapment, etc.

In addition, turbulences in a molten steel stream and stagnation due to the turbulences are significantly reduced, so that it becomes possible to suppress adherence of inclusions in steel to a wall surface of the immersion nozzle around the discharge port, which would otherwise occur in a region having the stagnation.

Therefore, it becomes possible to improve slab quality. Further, it becomes possible to suppress a change in shape of a portion including an inner bore of the immersion nozzle around the discharge port due to local wear caused by mold powder entrapment, etc., and thus suppress a change in discharge flow and shortening of usable life of the immersion nozzle, due to the change in shape.

DESCRIPTION OF EMBODIMENTS

Figure 1:
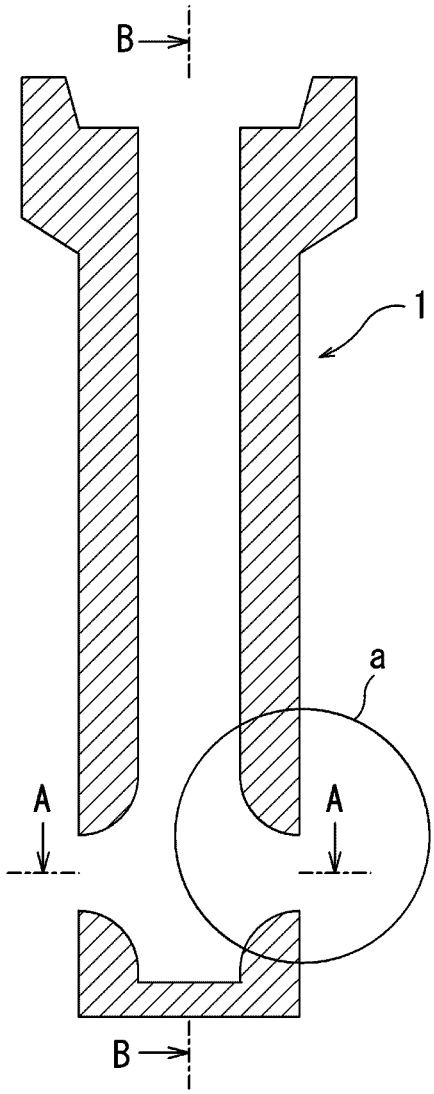
FIG. 1 is a schematic longitudinal sectional view of an immersion nozzle of the present invention.
Figure 2:
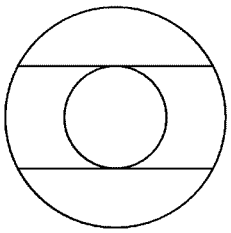
FIG. 2 is a schematic sectional view taken along the line A-A in FIG. 1.
Figure 3:
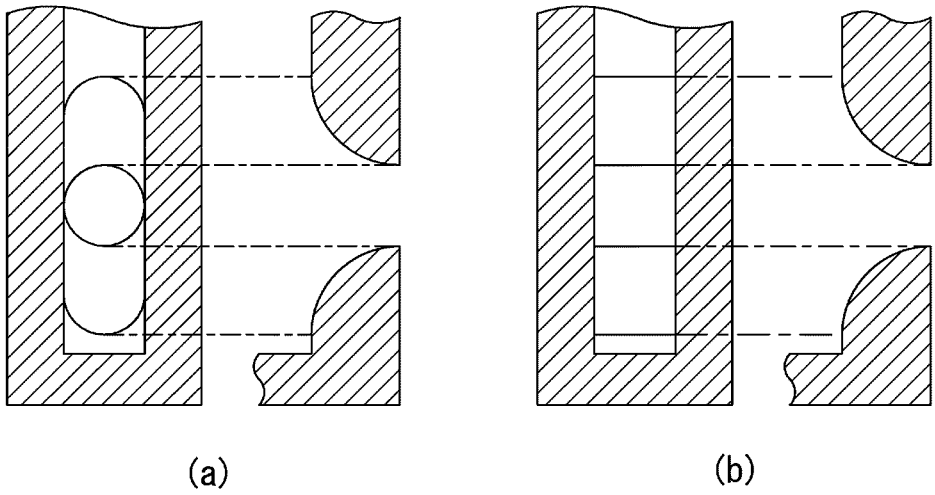
FIG. 3 is a fragmentary schematic sectional view taken along the line B-B in FIG. 1 (together with a fragmentary schematic longitudinal sectional view), wherein FIG. 3(*a*) illustrates a shape of a discharge port in one embodiment of the present invention (in an Experimental Example), and FIG. 3(*b*) illustrates a shape of a discharge port in another embodiment of the present invention (wherein an upper edge has a linear shape when viewed in a lateral direction).
Figure 4:
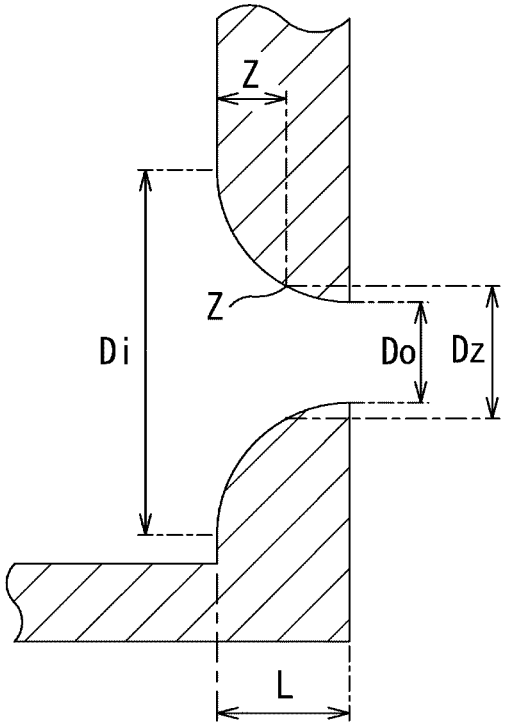
FIG. 4 is a schematic enlarged sectional view of the area "a" in FIG. 1.
Figure 5:
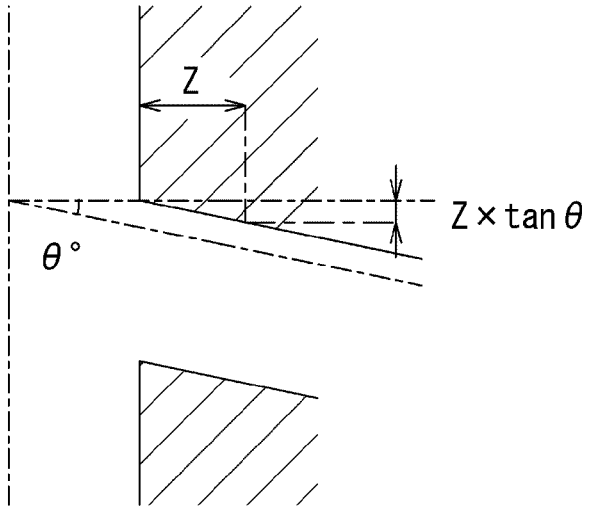
FIG. 5 illustrates a method of shifting a cross-section when a discharge port has an angle in a longitudinal direction of the immersion nozzle (except an angle toward a horizontal direction) (tan θ, etc.)

The present invention will now be described based on an embodiment thereof

In the present invention, stabilization of a molten steel stream in a discharge port and flow-straightening based on prevention of turbulences are determined by a position in a molten steel flow direction, i.e., a moving direction of the molten steel stream (hereinafter also referred to "downstream position") and a pressure distribution at respective positions. In other words, they are determined by a state of transition of energy loss in a molten steel stream at a start position of a discharge port and respective positions downstream of the start position.

Fundamentally, energy for producing a flow velocity of molten stream passing through a discharge port of an immersion nozzle is equivalent to a hydrostatic head (hydrostatic height) of molten steel. Thus, a flow velocity V(z) of molten steel at a position downstream of the start position of the discharge port by a distance Z is expressed as the following formula (3):

$$V(z)=k(2g(H+Z))^{1/2}, \quad (3)$$

where: g is a gravitational acceleration; H is a hydrostatic head (hydrostatic height) of molten steel; and k is a flow coefficient.

A flow volume Q of molten steel passing through the discharge port of the immersion nozzle is a product of the flow velocity V and a cross-sectional area A of the discharge port. Thus, the flow volume Q is expressed as the following formula (4):

$$Q=V(L)\times A(L)=k(2g(H+L))^{1/2}\times A(L), \quad (4)$$

where: L is a length of the discharge port; V(L) is a flow velocity of molten steel at an end (on an outer peripheral surface of the immersion nozzle) of the discharge port; and A(L) is a cross-sectional area of the discharge port at the start position thereof.

The flow volume Q is constant in a cross section taken along a plane perpendicular to an axis of the discharge port in the molten-steel moving direction, at any position in the discharge port. Thus, a cross-sectional area A(z) at a position downstream of the start position of the discharge port by the distance Z is expressed as the following formula (5):

$$A(z)=Q/V(z)=k(2g(H+L))^{1/2}\times A(L)/k(2g(H+z))^{1/2} \quad (5)$$

Then, the following formula (6) is obtained by dividing each of the right-hand and left-hand sides of the formula (5) by A(L):

$$A(z)/A(L)=((H+L)/(H+Z))^{1/2} \quad (6)$$

A(z) and A(L) are expressed as follows: $A(z)=\pi Dz^2/4$, and $A(L)=\pi Do^2/4$, where: π is a ratio of the circumference of a circle to its diameter; Di is a diameter of the discharge port at the start position thereof; Do is a diameter of the discharge port at the end thereof; and Dz is a diameter of the discharge port at a position away from the start position toward the end thereof by the distance Z.

Thus, the formula (6) is transformed as follows:

$$A(z)/A(L)=(\pi Dz^2/4)/(\pi Do^2/4)=((H+L)/(H+Z))^{1/2} \quad (7)$$

$$Dz^2/Do^2=((H+L)/(H+Z))^{1/2} \quad (8)$$

$$Dz=((H+L)/(H+Z))^{1/4}\times Do \quad (9)$$

Therefore, the following relationship is satisfied:

$$1n(Dz)=(1/4)\times 1n((H+L)/(H+Z))+1n(Do) \quad (10)$$

An energy loss (pressure loss) can be minimized by forming the discharge port into a cross-sectional shape satisfying the formula 9 (formula 10).

As for the above formulas, the inventors found out that H is substantially negligibly small, in a flow directionally changed toward the discharge port of the immersion nozzle. This is because: a flow volume of molten steel is adjusted by a flow-volume control device in the vicinity of an upper end of the immersion nozzle, so that a hydrostatic head above the flow-volume control device is blocked by control device and thereby considered as zero; and, although a hydrostatic head of molten steel in (the inner bore of) the immersion nozzle is produced over a length of the immersion nozzle below an upper end of a mold, and a molten steel stream in this region flows in a longitudinal direction of the immersion nozzle, the molten steel stream flows into the discharge port after a direction of the molten steel stream is changed due to collision with a bottom of the immersion nozzle, so that the molten steel stream constantly flows under a condition that a pressure thereof is cancelled out.

Thus, based on the above formulas about flow, H can be expressed as (transformed into) the aforementioned formula 2.

When the formula 10 is plotted on a graph, a quartic curve is formed. A pressure loss of molten steel can also be minimized by forming the discharge port into a cross-sectional shape equivalent to the graph based on the formula 10. In addition, in the shape satisfying the formula 10, a pressure of the molten steel is gradually (gently) reduced at each position downstream of the start position of the discharge port by the distance Z, so that a flow-straightened state is established (see FIGS. 1 to 6).

As for an effect of this formula in the present invention, a fluid analysis based on computer simulation (high reproducibility/correlativity with actual casting operations has been verified) was carried out to obtain a distribution of molten steel velocities in a region where molten steel is discharged from the end of the discharge port (see the following Examples).

Figure 41:
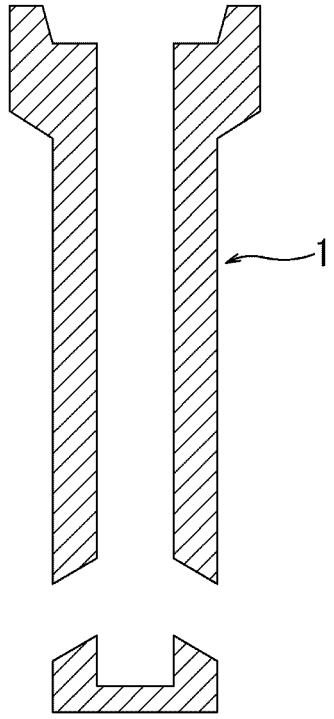
FIG. 41 is a schematic longitudinal sectional view of a conventional immersion nozzle (the comparative example 1 (angle=zero), the comparative example 2 (angle=20 degrees), the comparative example 4 (angle=20 degrees)).
Figure 42:
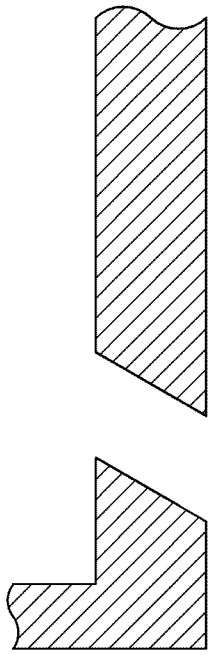
FIG. 42 is a schematic enlarged view of a discharge port in FIG. 41.

As a result, it was verified that a uniform state of a molten steel stream can be significantly enhanced, as compared with a conventional technique (wherein an inner bore of an immersion nozzle and a discharge port extending in a molten-steel outflow direction intersects with each other as two straight lines, at a start position of the discharge port; see FIGS. 41 and 42). This means that a molten steel stream flowing downwardly along an inner bore of the immersion nozzle is directionally changed toward the discharge port in such a manner as to form a smooth (uniform/constant) molten steel stream with less energy loss at the end of the discharge port.

Further, in the present invention, conditions for the shape satisfying the above formula were checked up. Specifically, an effect of a basic and optimal shape satisfying the above formula was checked based on computer simulation in the same manner, while changing a value of n in the formula 10 (hereinafter also referred to as "degree").

As a result, it was found out that the same significant effect as that in the degree "4" can be obtained when the degree is 1.5 or more (at least 6.0 or less) (see FIGS. 13 to 18).

Thus, if an inner surface of the discharge ports has a shape defined by a curved line along which an inner bore of the discharge port is gradually reduced in diameter in a direction from the start position to the end of the discharge port, and the curved line is configured to satisfy the formula 10 having n=1.5 or more, the uniforming effect can be significant enhanced, as compared with the conventional technique (wherein a surface of an inner bore of an immersion nozzle and a surface of an inner bore of a discharge port intersects with each other as two flat planes).

In other words, based on a presupposition that the inner bore of the discharge port is gradually reduced in diameter in a direction from the start position to the end of the discharge port, the inner surface of the discharge port may be comprised of a plurality of curved lines each formed by setting "n" to a different value, instead of forming the curved line by setting "n" to only one specific value in the range of 1.5 or more.

The inventers experimentally verified that there is no significant difference in the molten-steel flow velocity-uniforming effect as long as "n" is 6.0 or less (see the following Examples).

The uniforming effect is maximally obtained at a constant level when "n" is in the range of 2.0 to 4.5. Moreover, no further improvement in the uniforming effect is observed when "n" is 6.0, and a curvature of a curved line in the vicinity of the start position of the discharge port is apt to gradually become smaller if "n" is increased beyond 6.0 (see FIGS. 6(*a*) to 6(*c*)). Thus, practically, a necessity and a merit to employ a configuration formed by setting "n" to a value greater than 6.0 cannot be found out.

Furthermore, in the present invention, an influence of the ratio "Di/Do" was checked up. As a result, it was experimentally verified that the molten-steel flow velocity-uniforming effect is gradually enhanced as the ratio "Di/Do" is increased from 1.6 up to 2 (see the following Examples, and FIGS. 20 to 24).

Practically, a configuration formed by setting the ratio "Di/Do" to a value greater than 2.0 is not realistic, because it involves an excessive increase in overall length or immersion depth of an immersion nozzle, so that a problem, such as interference with a solidified layer (shell) of molten steel in a mold, is likely to occur.

A production method for an immersion nozzle of the present invention will be described below.

The immersion nozzle of the present invention may be produced by a conventional method using a conventional mixture, for example, comprising: adding a binder to a refractory raw material; kneading them to obtain a mixture; subjecting the mixture to a CIP process, while placing a core or a rubber mold having a given shape of the present invention in a position corresponding to an inner wall surface of a discharge port, to form an integral body; and then subjecting the body to drying, burning and machining such as grinding.

For example, the inner wall surface of the discharge port may be formed by a method which comprises: pre-attaching a die formed in a desired shape, to a forming die (core) for a portion to be formed as an inner bore of the discharge port; compressing and molding a mixture having a given thickness, using a rubber mold to form an inner bore of the discharge port into the desired shape during the molding. Alternatively, it may be formed by a method which comprises: forming an immersion nozzle having a solid wall; and then machining the wall to form an inner bore of the discharge port having a desired shape.

EXAMPLES

FIGS. 7 to 28 are graphs for the following examples, wherein computer-simulated flow velocities are plotted with respect to a vertical position at an end of a discharge port (molten-steel discharge position).

FIGS. 29 to 40 are computer-simulated images for the following examples, each of which shows a flow state of molten steel at the end of a discharge port of an immersion nozzle, around the immersion nozzle and in a mold, just after the molten steel flows out of the discharge port.

Example A

In the Example A, a fluid analysis based on computer simulation was carried out to evaluate stability and smoothness of a molten steel stream.

Figure 6:
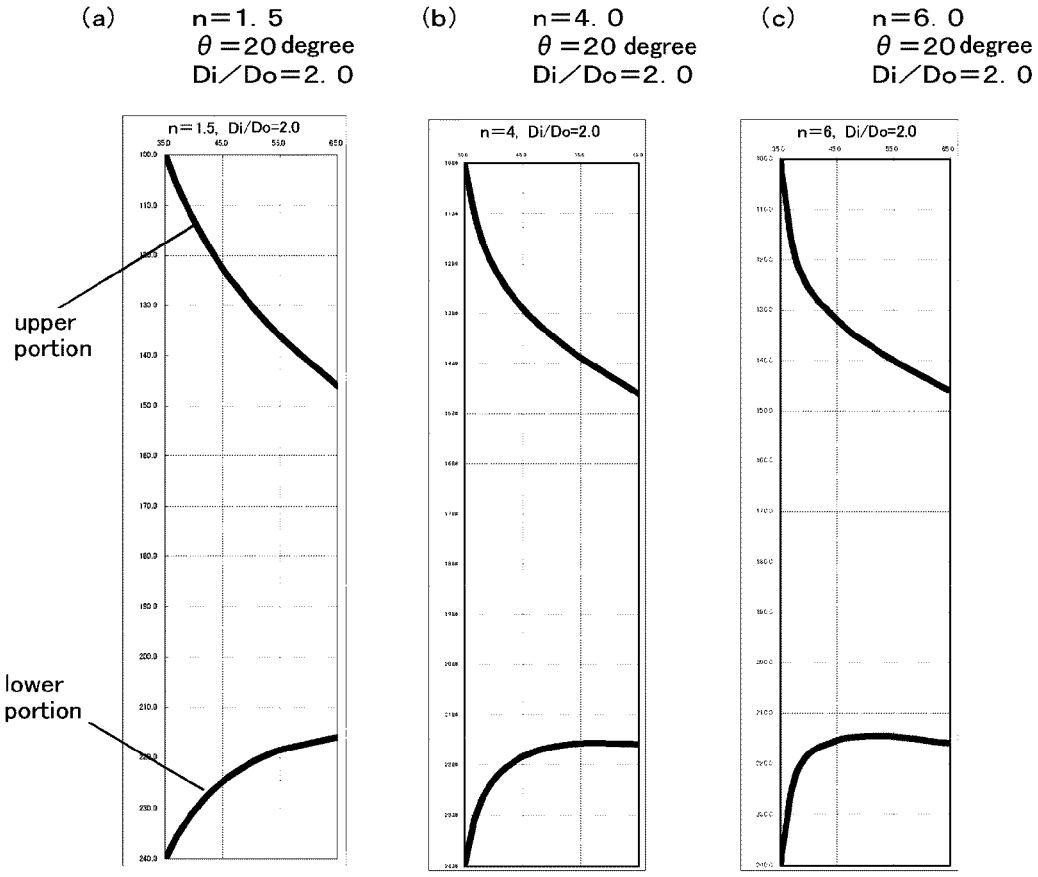
FIG. 6 illustrates a discharge port having an angle of 20 degrees in a downward direction, in a longitudinal cross-section of the immersion nozzle of the present invention, wherein: n=1.5 and Di/Do=2.0 in FIG. 6(*a*); n=4.0 and Di/Do=2.0 in FIG. 6(*b*); and n=6.0 and Di/Do=2.0 in FIG. 6(*c*).

Firstly, a discharge port in the present invention (inventive example 1; FIG. 1; the discharge port has an angle of 20 degrees in a downward direction, as shown in FIG. 6(*b*)) was compared with a conventional discharge port (comparative example 1, wherein an inner bore wall of an immersion nozzle and an inner bore wall of the discharge port intersect with each other as two straight lines, in the vicinity of a start position of the discharge port; FIGS. 41 and 42; the discharge port has an angle of 20 degrees in a downward direction).

In the inventive example 1, "n" was set to 4.0, and "Di/Do" was set to 2.0. In the comparative example 1, "Di/Do" was set to 1.0.

The molten-steel flow velocity-uniforming effect was evaluated based on the variation coefficient (standard deviation σ/average flow velocity Ave), the presence or absence of reversal of flow velocity (level) in a heightwise direction of the discharge port, and the presence or absence of a region where a flow velocity (level) has a negative value (negative-value region).

A smaller variation coefficient is better. It is desirable that there is no difference at respective vertical positions of the discharge port (in a graph having a horizontal axis representing a vertical position of the discharge port and a vertical axis representing a flow velocity, the uniforming effect can be considered to be high when the flow velocity is approximate constant (flow velocities are distributed in an approximately horizontal (lateral) direction).

If there is the reversal of flow velocity (level) in the heightwise direction of the discharge port, turbulences, such as a swirl, occur in a flow direction around the reversal region to cause spreading of a molten steel stream, occurrence of a mold-powder entrapment flow, etc. Therefore, it is desirable to eliminate the reversal.

The presence of the negative-value region has a means that there is a reversely-oriented flow in the region. Thus, significant turbulences including a swirl occur in a flow direction around the region to cause spreading of a molten steel stream, occurrence of a mold-powder entrapment flow, etc. Therefore, it is desirable to eliminate the negative-value region (reverse flow).

This simulation was performed using fluid analysis software (trade name: "Fluent Ver. 6.3.26" produced by ANSYS, Inc). Input parameters in the fluid analysis software were as follows:

- The number of calculational cells: about 120,000 (wherein the number can vary depending on a model)
- Fluid: water (wherein it has been verified that the evaluation for molten steel can also be performed in a comparative manner)
  density=998.2 kg/m$^3$
  viscosity=0.001003 kg/m·s
- Outer diameter of a discharge-port portion of an immersion nozzle: 130 mm
- Diameter of an inner bore of the discharge port of the immersion nozzle: 70 mm
- Length L of the discharge port: 30 mm
- Immersion depth (center of an outlet of the discharge port): 181 mm
- Size of a mold: 220 mm×1800 mm
- Viscous Model: K-omega calculation
- Flow volume of molten steel: 5 l/s (about 2.1 ton/min)
- Angle of the discharge port: zero degree (direction perpendicular to a longitudinal axis of the immersion nozzle)

Figure 7:
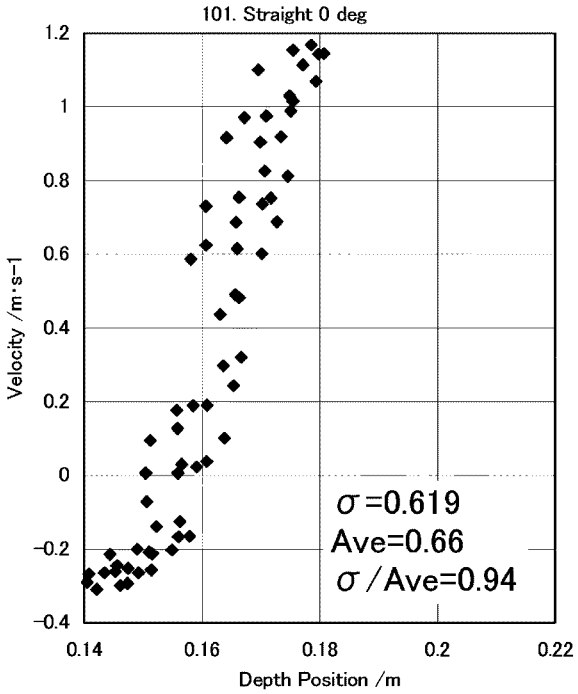
FIG. 7 shows a result of a comparative example 1 in Examples.
Figure 8:
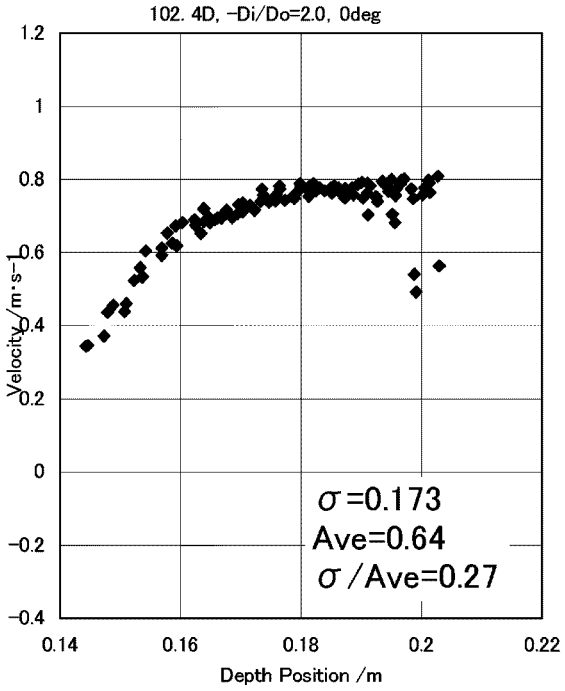
FIG. 8 shows a result of an inventive example 1.

A result of the simulation is shown in Table 1, and FIG. 8 and FIG. 7 which are a graph for the inventive example 1 and a graph for the comparative example 1, respectively, wherein flow velocities are plotted with respect to the vertical position at the end of the discharge port (molten-steel discharge position).

TABLE 1

| | | Comparative example 1 | Inventive example 1 |
|---|---|---|---|
| Conditions | Degree n | — | 4 |
| | Ratio Di/Do | 1 | 2.0 |
| | Discharge port angle (degree) | horizontal | horizontal |
| | Molten-steel flow volume (l/sec) | 5 | 5 |
| | Shape | cylindrical shape | present invention |
| Result | Average flow velocity Ave | 0.66 | 0.64 |
| | Standard deviation σ | 0.619 | 0.173 |
| | Variation coefficient σ/Ave | 0.94 | 0.27 |
| | Variation coefficient index *1 | 100 | 28.7 |
| | Negative value (reverse flow) | Occurrence | Non |
| | Reversal in heightwise direction | Non | Non |
| | Comprehensive evaluation | X | ○ |
| | Corresponding figure (graph) | 7 | 8 |

*1 with respect to comparative example 1: 100

As seen in this result, in the comparative example 1, the variation coefficient is 0.94, and there is the negative-value region although there is no reversal in a lower region of the discharge port.

In contrast, in the inventive example 1, the variation coefficient is significantly reduced to 0.27 (28.7, on an assumption that the variation coefficient in the comparative example 1 is 100), and there is neither the negative-value region nor the reversal in a lower region of the discharge port.

Example B

In the Example B, a fluid analysis based on the same computer simulation as that in the Example A was carried out under a condition that the angle of the discharge port is set to 20 degrees in a downward direction.

In the Example B, an inner bore of the discharge port with the angle is configured such that a position of the discharge port corresponding to an arbitrary distance Z in a longitudinal cross-section of the immersion nozzle (cross-section parallel to a longitudinal axis of the immersion nozzle) is gradually shifted in a direction parallel to the longitudinal axis of the immersion nozzle by a longitudinal distance depending on the angle θ at the position corresponding to the distance Z (distance Z×tan θ).

Figure 43:
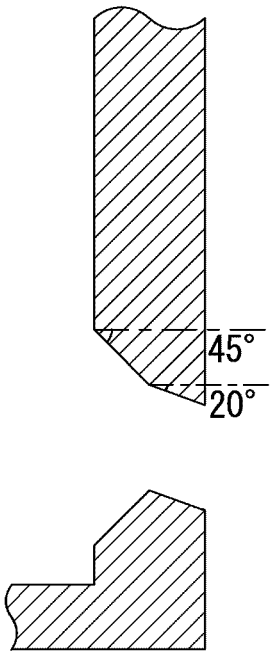
FIG. 43 is a schematic enlarged view of a two-step tapered discharge port.

In an inventive example 2, "n" is set to 4.0, and "Di/Do" is set to 2.0. In a comparative example 2, "Di/Do" is set to 1.0. In a comparative example 3, the discharge port is formed in a shape where two straight lines are connected in a two-step tapered manner to extend from the start position to the end of the discharge port (see FIG. 43).

Figure 9:
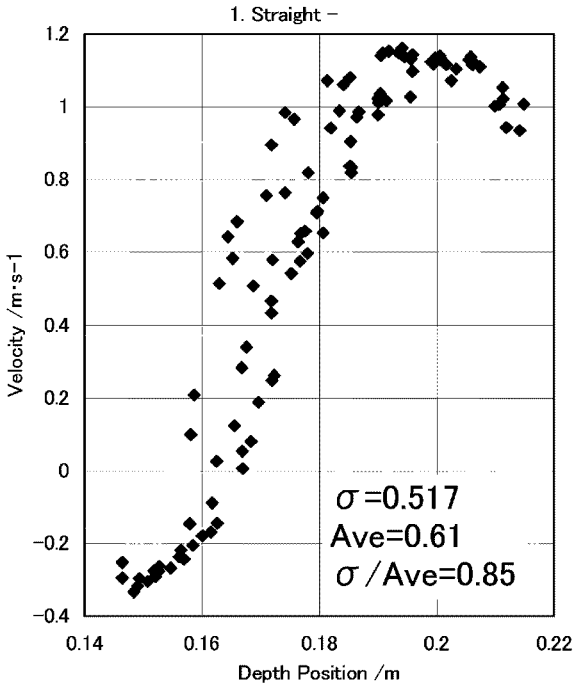
FIG. 9 shows a result of a comparative example 2.
Figure 10:
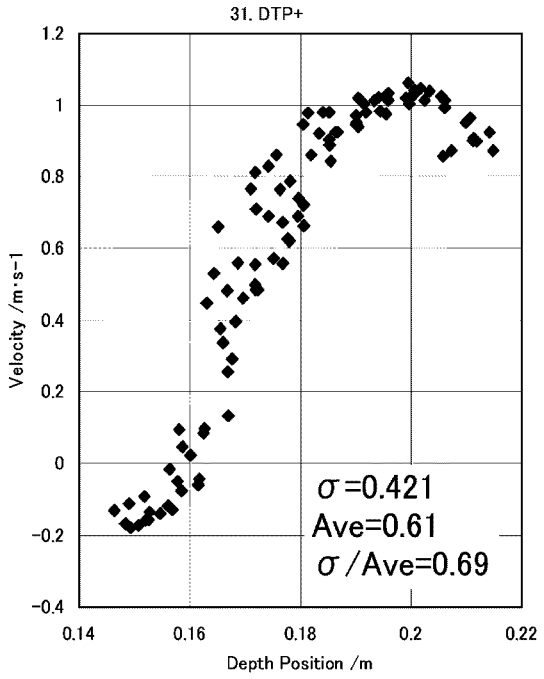
FIG. 10 shows a result of a comparative example 3.
Figure 11:
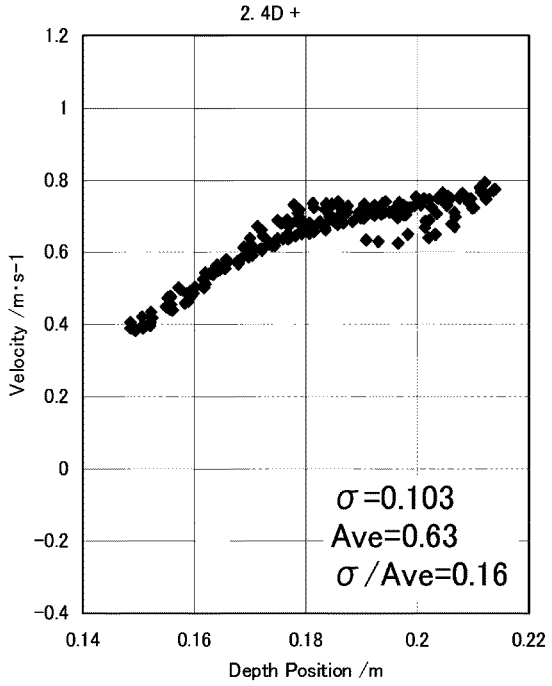
FIG. 11 shows a result of an inventive example 2.
Figure 12:
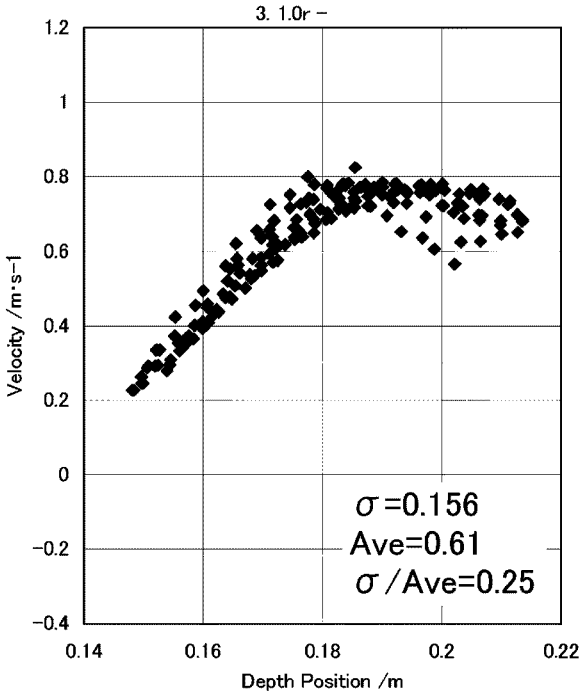
FIG. 12 shows a result of a comparative example 5.
Figure 13:
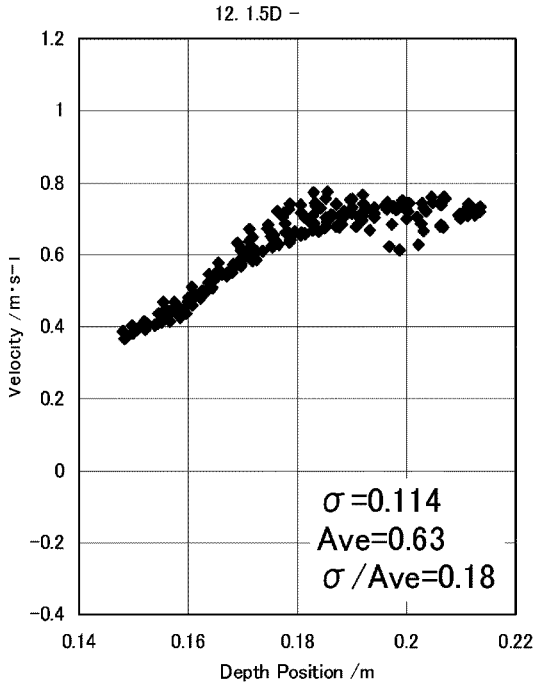
FIG. 13 shows a result of an inventive example 4.
Figure 14:
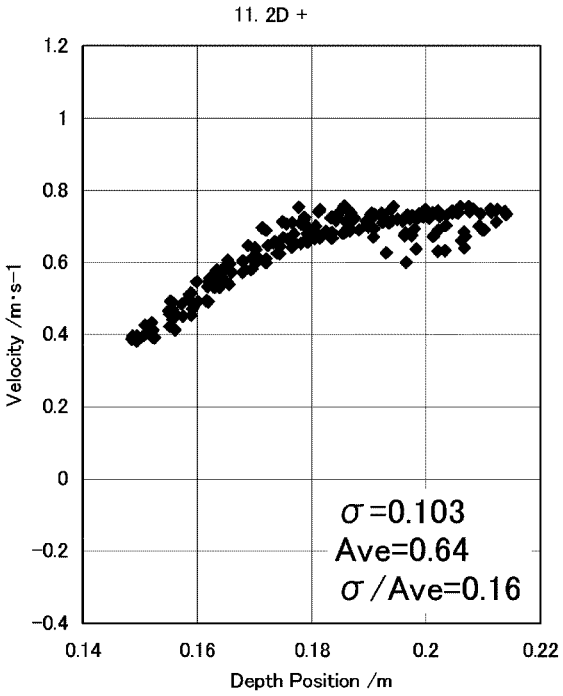
FIG. 14 shows a result of an inventive example 5.
Figure 15:
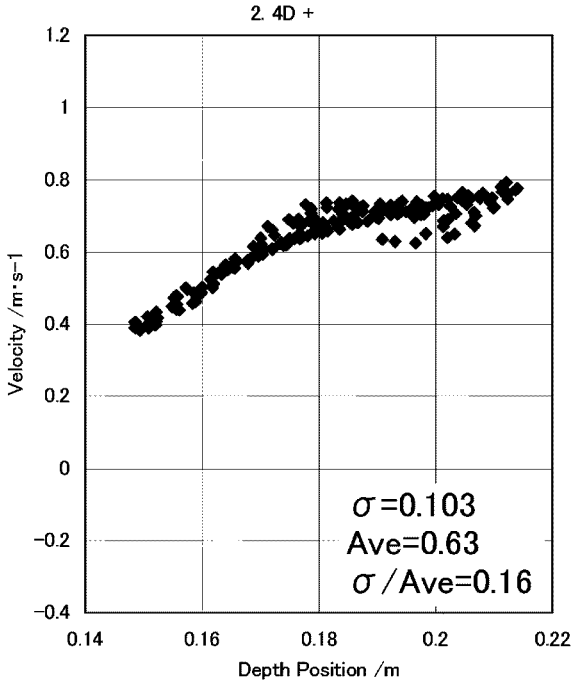
FIG. 15 shows a result of the inventive example 2.
Figure 16:
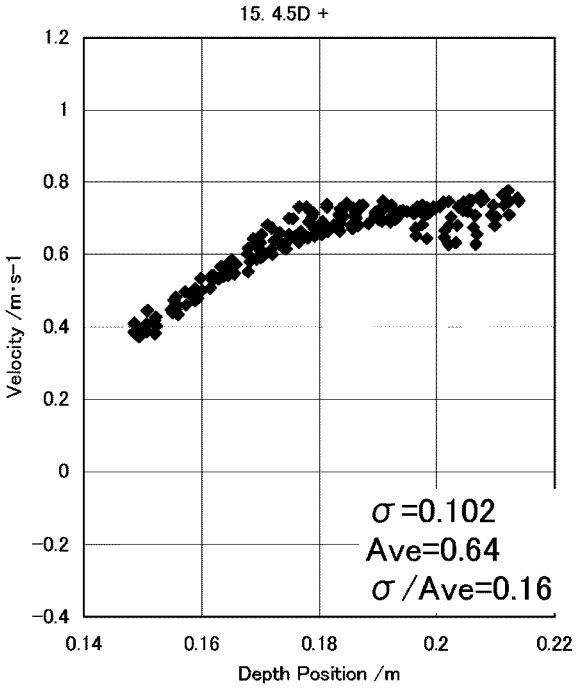
FIG. 16 shows a result of an inventive example 6.
Figure 17:
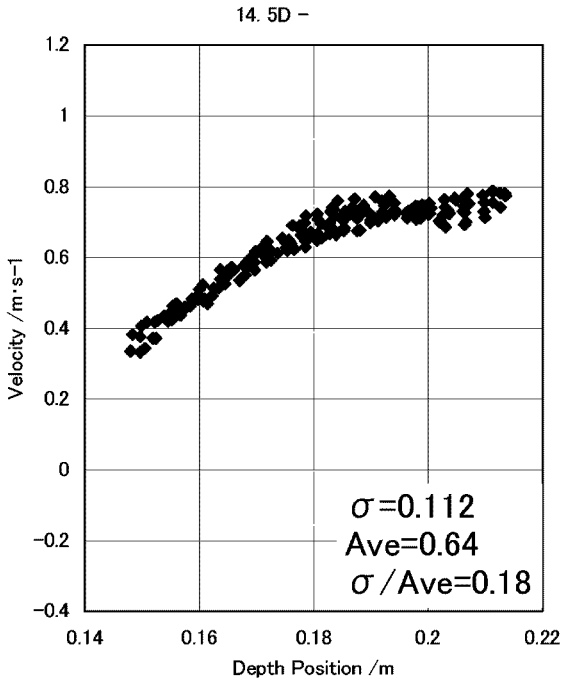
FIG. 17 shows a result of an inventive example 7.
Figure 18:
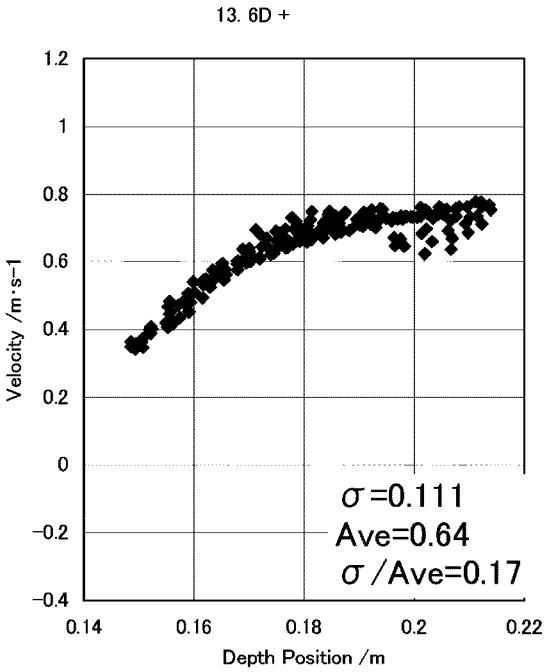
FIG. 18 shows a result of an inventive example 8.
Figure 19:
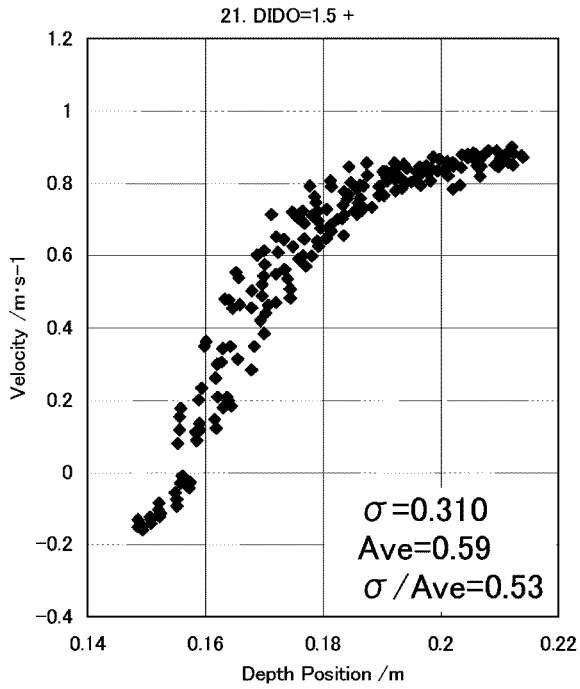
FIG. 19 shows a result of a comparative example 6.
Figure 20:
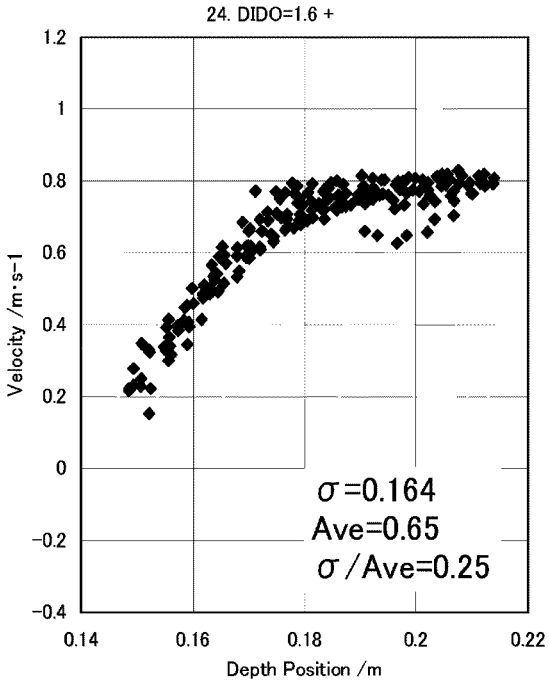
FIG. 20 shows a result of an inventive example 9.
Figure 21:
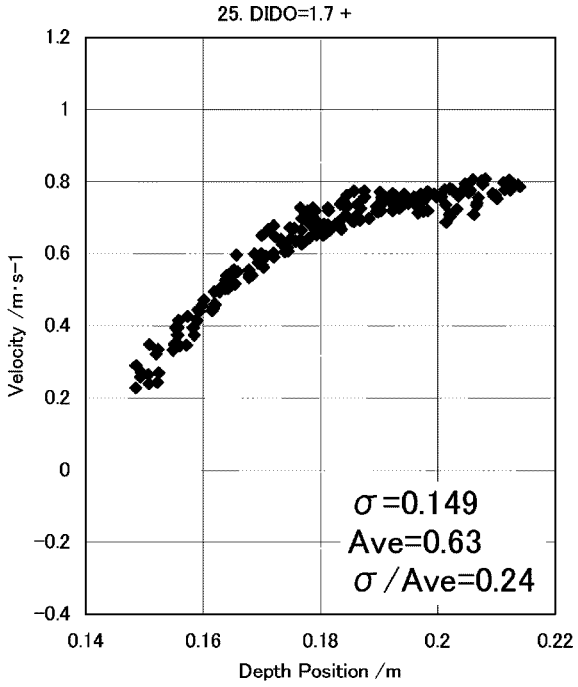
FIG. 21 shows a result of an inventive example 10.
Figure 22:
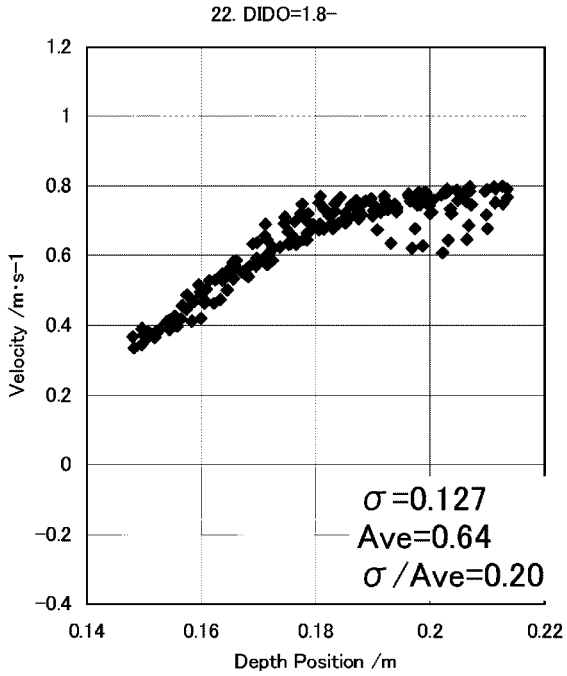
FIG. 22 shows a result of an inventive example 11.
Figure 23:
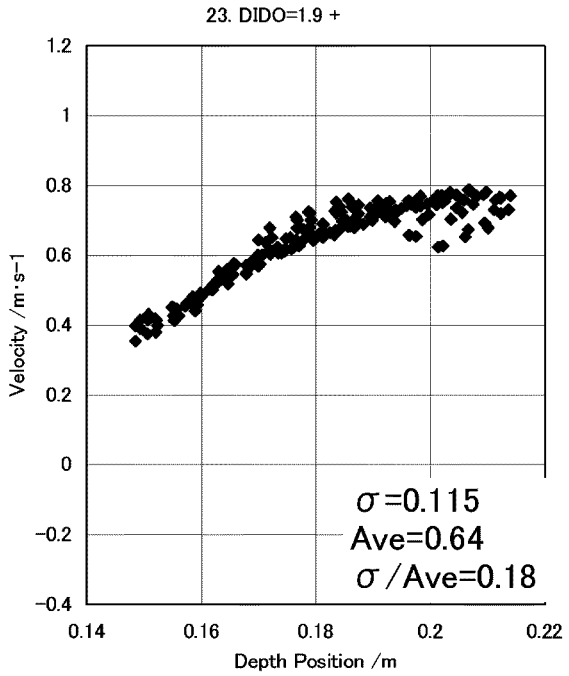
FIG. 23 shows a result of an inventive example 12.
Figure 24:
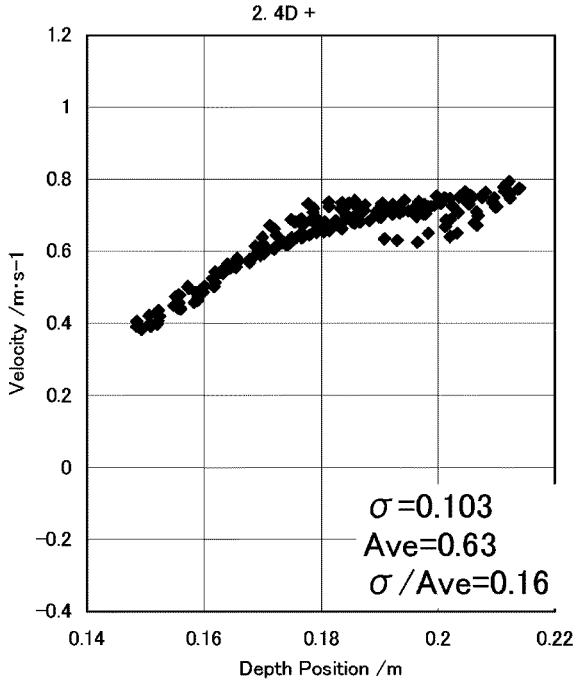
FIG. 24 shows a result of the inventive example 2.
Figure 25:
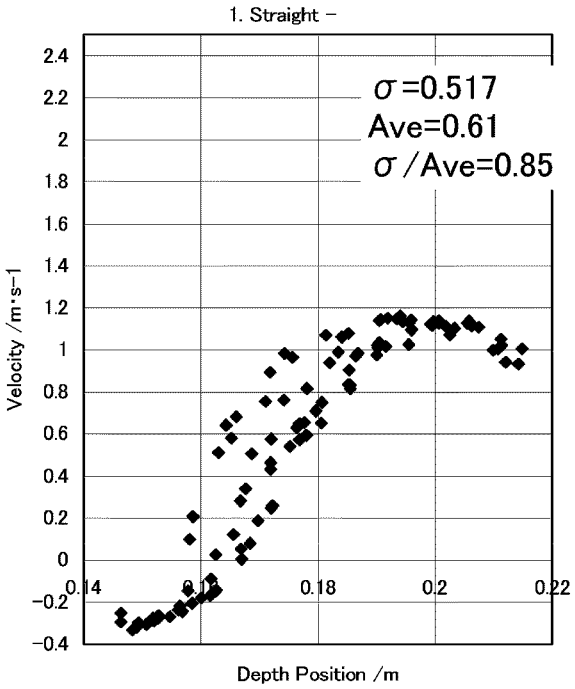
FIG. 25 is a graph formed by expanding a scale of the vertical axis of the graph for the comparative example 2 in FIG. 9.
Figure 26:
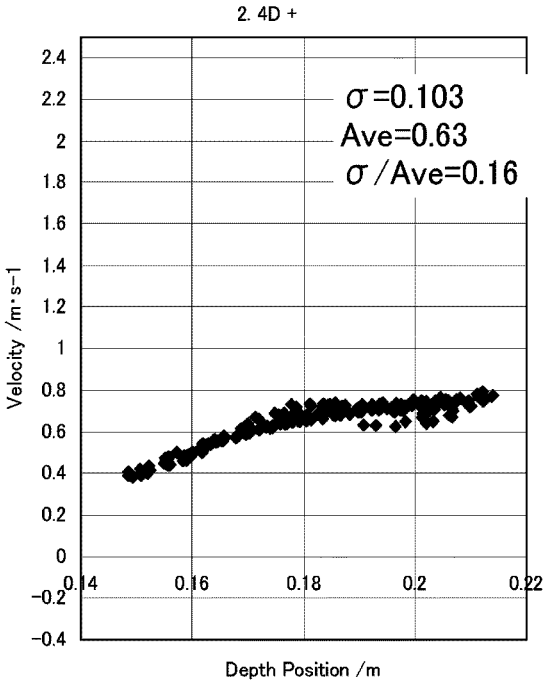
FIG. 26 is a graph formed by expanding a scale of the vertical axis of the graph for the inventive example 2 in FIG. 11.

A result of the simulation is shown in Table 2, and FIG. 11, FIG. 9 and FIG. 10 which are a graph for the inventive example 2, a graph for the comparative example 2 and a graph for the comparative example 3, respectively, wherein flow velocities are plotted with respect to the vertical position at the end of the discharge port (molten-steel discharge position).

TABLE 2

| | | Comparative example 2 | Comparative example 3 | Inventive example 2 |
|---|---|---|---|---|
| Conditions | Degree n | — | — | 4.0 |
| | Ratio Di/Do | 1 | | 2.0 |
| | Discharge port angle (degree) | downward 20 | downward 20 | downward 20 |
| | Molten-steel flow volume (l/sec) | 5 | 5 | 5 |
| | Shape | cylindrical shape | two-step tapered shape | present invention |
| Result | Average flow velocity Ave | 0.61 | 0.61 | 0.63 |
| | Standard deviation σ | 0.517 | 0.421 | 0.103 |
| | Variation coefficient σ/Ave | 0.85 | 0.69 | 0.16 |
| | Variation coefficient index*1 | 100 | 81.2 | 18.8 |
| | Negative value (reverse flow) | Occurrence | Occurrence | Non |
| | Reversal in heightwise direction | Occurrence | Occurrence | Non |
| | Comprehensive evaluation | X | X | ○ |
| | Corresponding figure (graph) | 9, 25 | 10 | 11, 26 |

*1with respect to comparative example 2: 100

As seen in this result, in the comparative example 2, the variation coefficient is 0.85, and there are the reversal in a lower region of the discharge port and the negative-value region in an upper region of the discharge port.

In the comparative example 3, on an assumption that the variation coefficient in the comparative example 2 is 100, a variation coefficient index is 81.2, which means that no significant improvement in the uniforming effect is observed with respect to the comparative example 2. Moreover, there are the reversal in a lower region of the discharge port and the negative-value region in an upper region of the discharge port. Thus, the uniforming effect based on the two-step tapered shape is not observed.

In contrast, in the inventive example 2, on an assumption that the variation coefficient in the comparative example 2 is 100, the variation coefficient index is 18.8, which means that a significant improvement in the uniforming effect is observed with respect to the comparative example 2. In addition, there is neither the negative-value region nor the reversal in a lower region of the discharge port.

Example C

In the Example C, a fluid analysis based on the same computer simulation as that in the Examples A and B was carried out to check an influence of a flow volume of molten-steel. Specifically, an inventive example 3 and a comparative example 4 were formed in the same configurations as those of the inventive example 2 and the comparative example 2 in the Example B, respectively, and the molten-steel flow volume was set to a value two times greater than that in the Example B to check an influence on the uniforming effect.

Figure 27:
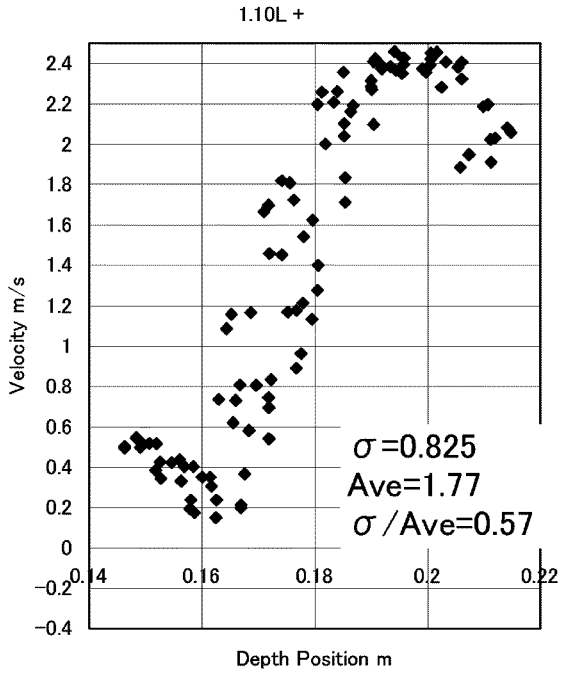
FIG. 27 shows a result of a comparative example 4 (the vertical axis has the same scale as that in FIGS. 25 and 26).
Figure 28:
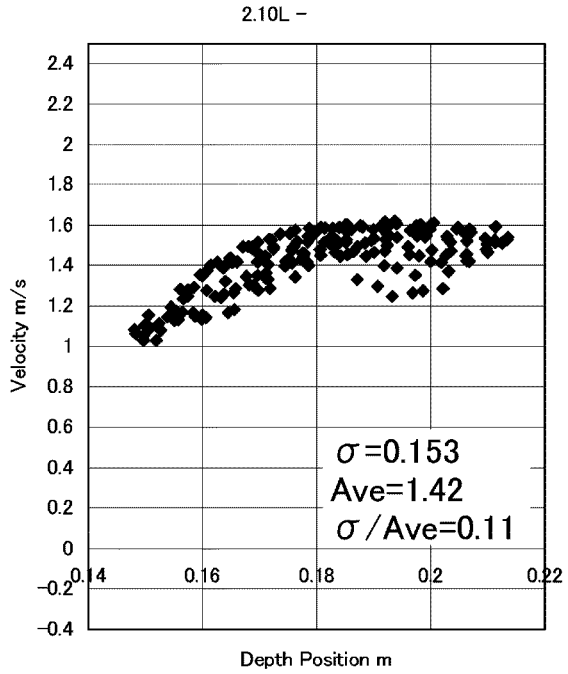
FIG. 28 shows a result of an inventive example 3 (the vertical axis has the same scale as that in FIGS. 25 and 26).
Figure 29:
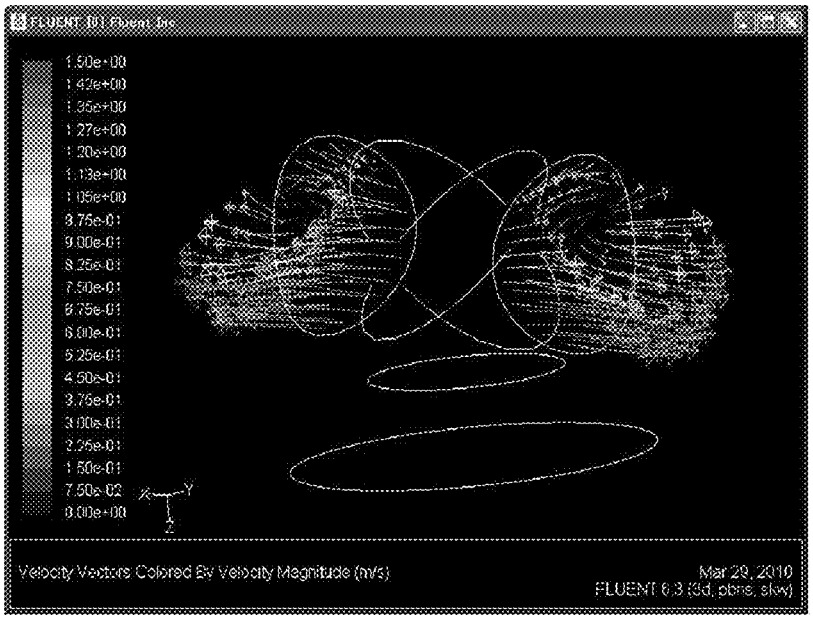
FIG. 29 is a computer-simulated image showing a flow state of molten steel at a molten-steel outlet of a discharge port of an immersion nozzle in the comparative example 1, just after the molten steel flows out of the discharge port.
Figure 30:
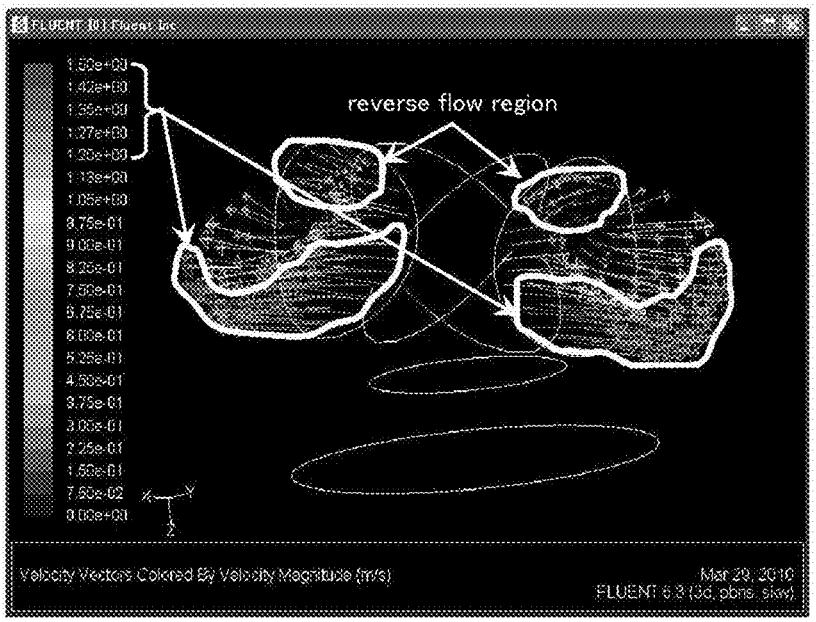
FIG. 30 is the image in FIG. 29, wherein a line and text for supplementary explanation of flow velocity are written thereon.
Figure 31:
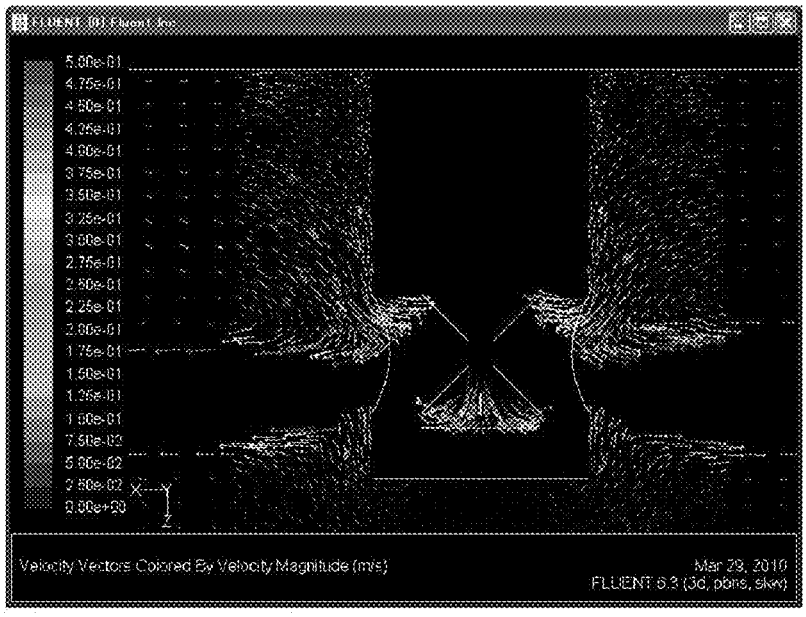
FIG. 31 is a computer-simulated image showing a flow state of molten steel in a bottom region inside an immersion nozzle having a discharge port in the comparative example 1 and in the vicinity of the immersion nozzle.
Figure 32:
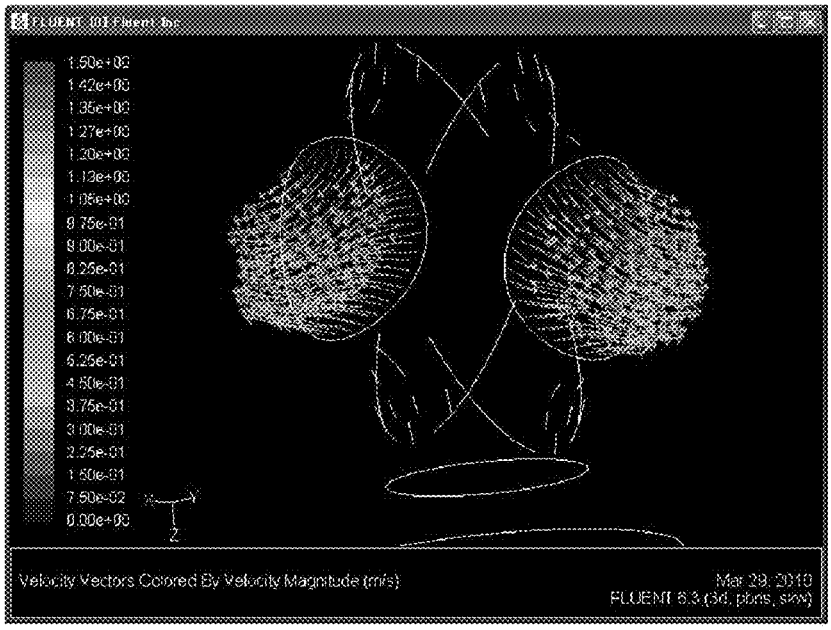
FIG. 32 is a computer-simulated image showing a flow state of molten steel at a molten-steel outlet of a discharge port of an immersion nozzle in the inventive example 1, just after the molten steel flows out of the discharge port.
Figure 33:
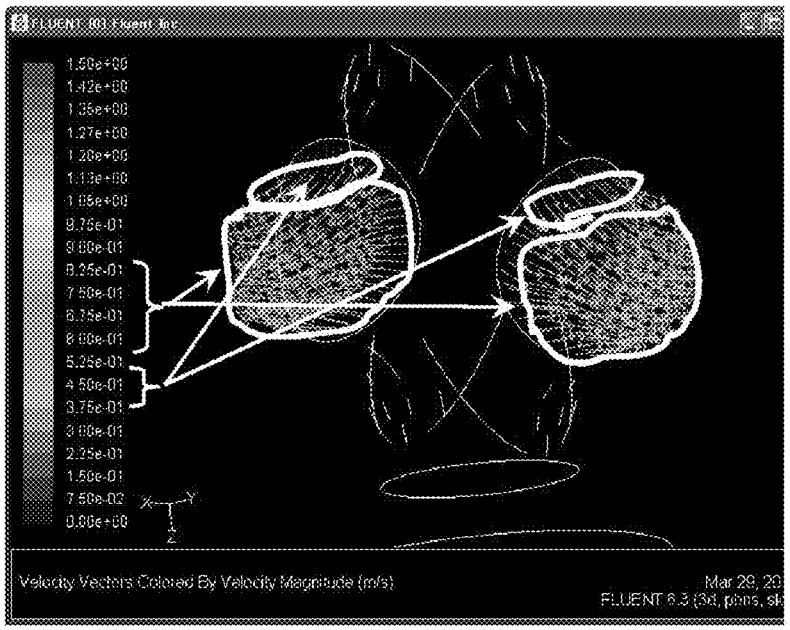
FIG. 33 is the image in FIG. 32, wherein a line for supplementary explanation of flow velocity is written thereon.
Figure 34:
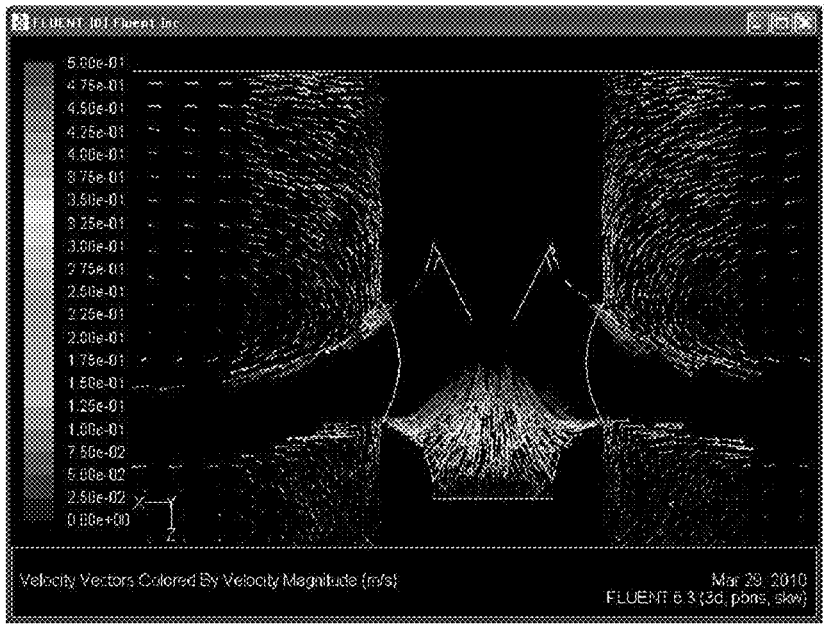
FIG. 34 is a computer-simulated image showing a flow state of molten steel in a bottom region inside the immersion nozzle having the discharge port in the inventive example 1 and in the vicinity of the immersion nozzle.
Figure 35:
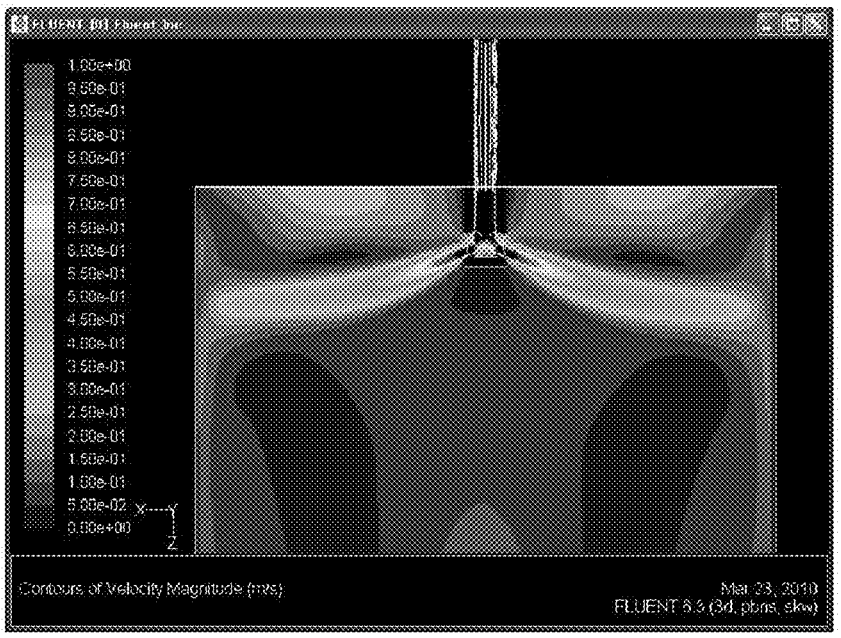
FIG. 35 is a computer-simulated image showing a flow state of molten steel in a mold, after the molten steel flows out of a discharge port of an immersion nozzle in the comparative example 2.
Figure 36:
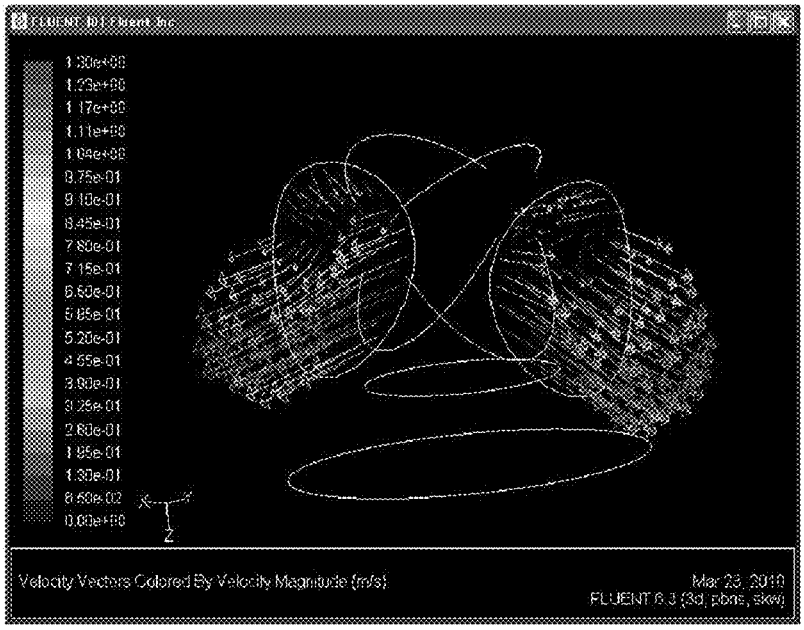
FIG. 36 is a computer-simulated image showing a flow state of molten steel at a molten-steel outlet of the discharge port of the immersion nozzle in the comparative example 2, just after the molten steel flows out of the discharge port.
Figure 37:
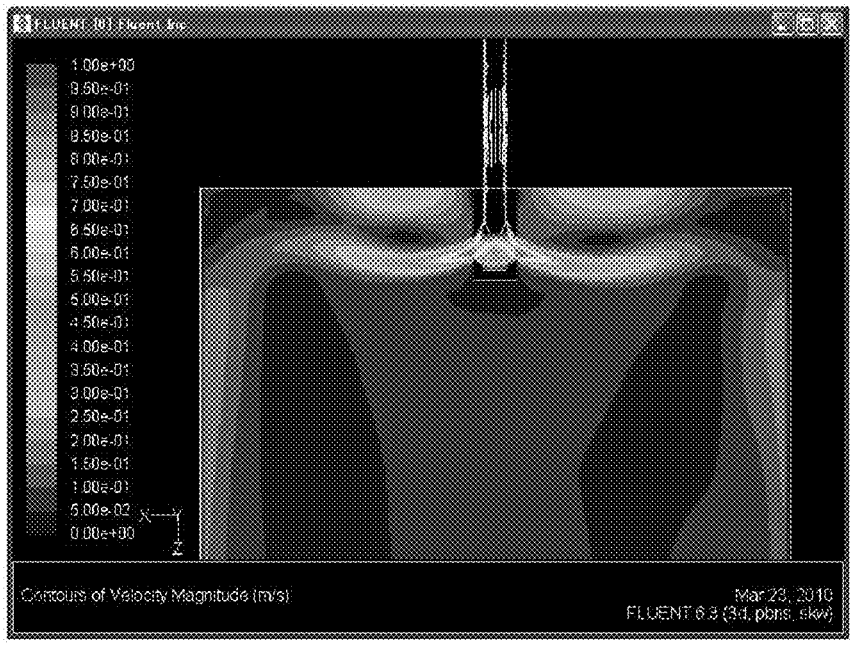
FIG. 37 is a computer-simulated image showing a flow state of molten steel in a mold, after the molten steel flows out of a discharge port of an immersion nozzle in the comparative example 5.
Figure 38:
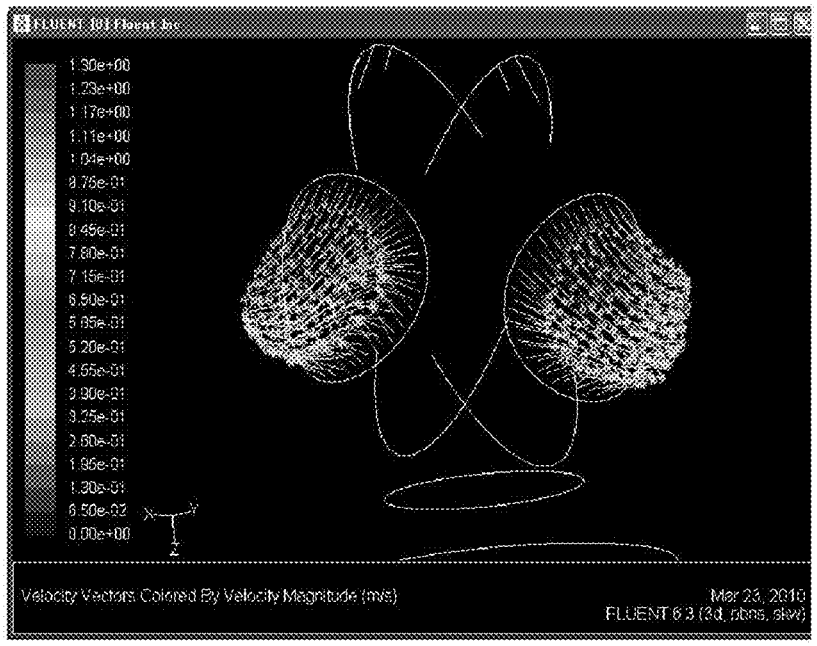
FIG. 38 is a computer-simulated image showing a flow state of molten steel at a molten-steel outlet of the discharge port of the immersion nozzle in the comparative example 5, just after the molten steel flows out of the discharge port.
Figure 39:
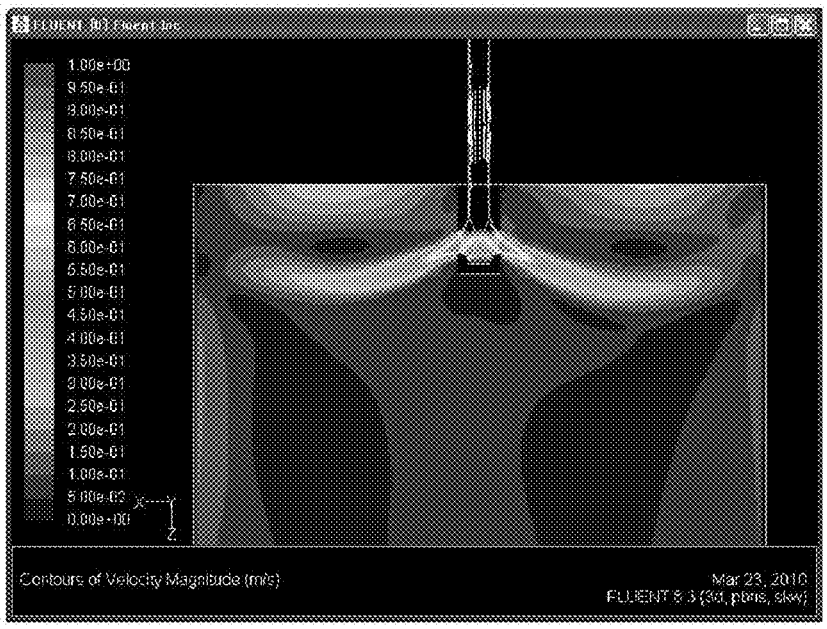
FIG. 39 is a computer-simulated image showing a flow state of molten steel in a mold, after the molten steel flows out of a discharge port of an immersion nozzle in the inventive example 2.
Figure 40:
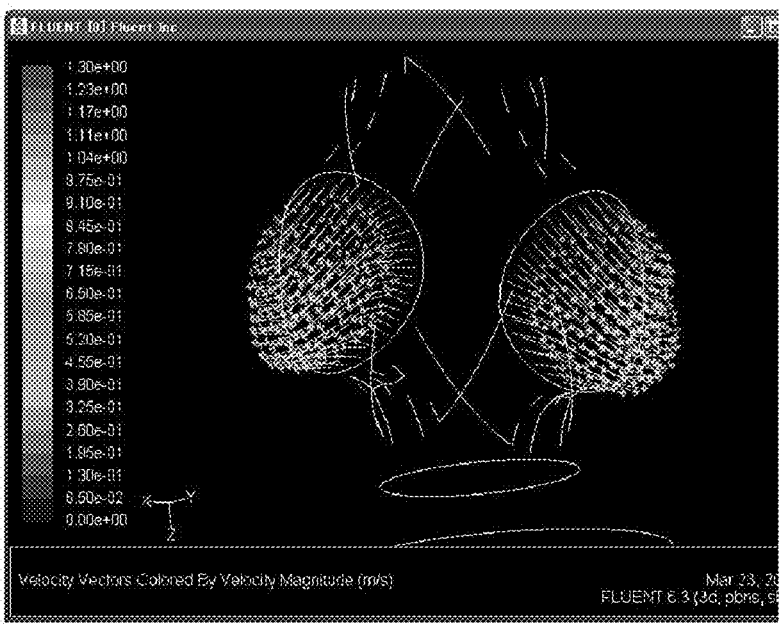
FIG. 40 is a computer-simulated image showing a flow state of molten steel at a molten-steel outlet of the discharge port of the immersion nozzle in the inventive example 2, just after the molten steel flows out of the discharge port.

A result of the simulation is shown in Table 3, and FIG. 28 and FIG. 27 which are a graph for the inventive example 3 and a graph for the comparative example 4, respectively, wherein flow velocities are plotted with respect to the vertical position at the end of the discharge port (molten-steel discharge position).

TABLE 3

| | | Comparative example 4 | Inventive example 2 |
|---|---|---|---|
| Conditions | Degree n | — | 4.0 |
| | Ratio Di/Do | 1 | 2.0 |
| | Discharge port angle (degree) | downward 20 | downward 20 |

TABLE 3-continued

| | | Comparative example 4 | Inventive example 2 |
|---|---|---|---|
| | Molten-steel flow volume (l/sec) | 10 | 10 |
| | Shape | cylindrical shape | present invention |
| Result | Average flow velocity Ave | 1.77 | 1.42 |
| | Standard deviation σ | 0.825 | 0.153 |
| | Variation coefficient σ/Ave | 0.57 | 0.11 |
| | Variation coefficient index *1 | 100 | 19.3 |
| | Negative value (reverse flow) | Occurrence | Non |
| | Reversal in heightwise direction | Occurrence | Non |
| | Comprehensive evaluation | X | ○ |
| | Corresponding figure (graph) | 27 | 28 |

*1 with respect to comparative example 5: 100

As seen in this result, in the comparative example 4, the variation coefficient is 0.57, and there are the reversal in a lower region of the discharge port and the negative-value region in an upper region of the discharge port. This means that a flow characteristic on the uniformity is not changed even if the molten-steel flow volume is increased.

In contrast, in the inventive example 3, on an assumption that the variation coefficient in the comparative example 4 is 100, the variation coefficient index is 19.3, which means that a significant improvement in the uniforming effect is observed with respect to the comparative example 4. In addition, there is neither the negative-value region nor the reversal in a lower region of the discharge port. This means that the uniforming effect of the present invention can also be obtained even if the molten-steel flow volume is increased.

Example D

In the Example D, a fluid analysis based on the same computer simulation as that in the Examples A and B was carried out to check an influence of "n".

As conditions for the simulation, "Di/Do" was set to 2.0, and the molten-steel flow volume was set to 5 l/s (about 2.1 ton/min) as with the Example B. Further, the angle of the discharge port was set to 20 degrees in a downward direction, and "n" was changed in the range of 1.0 (corresponding to a linear taper shape) to 6.0.

A result of the simulation is shown in Table 4, and FIG. 12 and FIGS. 13 to 18 which are a graph for a comparative example 5 and graphs for inventive examples 4 to 8 (including the inventive example 2), respectively, wherein flow velocities are plotted with respect to the vertical position at the end of the discharge port (molten-steel discharge position).

TABLE 4

| | | Comparative example 5 | Inventive example 4 | Inventive example 5 | Inventive example 2 |
|---|---|---|---|---|---|
| Conditions | Degree n | 1.0 | 1.5 | 2.0 | 4.0 |
| | Ratio Di/Do | 2.0 | 2.0 | 2.0 | 2.0 |
| | Discharge port angle (degree) | downward 20 | downward 20 | downward 20 | downward 20 |
| | Molten-steel flow volume (l/sec) | 5 | 5 | 5 | 5 |
| Result | Average flow velocity Ave | 0.61 | 0.63 | 0.64 | 0.63 |
| | Standard deviation σ | 0.156 | 0.114 | 0.103 | 0.103 |
| | Variation coefficient σ/Ave | 0.25 | 0.18 | 0.16 | 0.16 |
| | Variation coefficient index *1 | 29.4 | 21.2 | 18.8 | 18.8 |
| | Negative value (reverse flow) | Non | Non | Non | Non |
| | Reversal in heightwise direction | Occurrence | Non | Non | Non |
| | Comprehensive evaluation | X | ○ | ○ | ○ |
| | Corresponding figure (graph) | 12 | 13 | 14 | 15 |

| | | Inventive example 6 | Inventive example 7 | Inventive example 8 |
|---|---|---|---|---|
| Conditions | Degree n | 4.5 | 5.0 | 6.0 |
| | Ratio Di/Do | 2.0 | 2.0 | 2.0 |
| | Discharge port angle (degree) | downward 20 | downward 20 | downward 20 |
| | Molten-steel flow volume (l/sec) | 5 | 5 | 5 |
| Result | Average flow velocity Ave | 0.64 | 0.64 | 0.64 |
| | Standard deviation σ | 0.102 | 0.112 | 0.111 |
| | Variation coefficient σ/Ave | 0.16 | 0.18 | 0.17 |
| | Variation coefficient index *1 | #REF! | #REF! | #REF! |
| | Negative value (reverse flow) | Non | Non | Non |
| | Reversal in heightwise direction | Non | Non | Non |
| | Comprehensive evaluation | ○ | ○ | ○ |
| | Corresponding figure (graph) | 16 | 17 | 18 |

*1 with respect to comparative example 2: 100

As seen in this result, in the comparative example 5 where "n" is set to 1.0 (corresponding to a linear taper shape), on an assumption that the variation coefficient in the comparative example 2 is 100, the variation coefficient index is 29.4, which means that a significant improvement in the uniforming effect is observed. However, there is the reversal in a lower region of the discharge port although the negative-value region in an upper region of the discharge port is not observed.

In contrast, in the inventive examples, on an assumption that the variation coefficient in the comparative example 2 is 100, the inventive example 4 where "n" is set to 1.5, has a variation coefficient index of 21.2, and each of the inventive examples 5, 2, 6 where "n" is set in the range of 2.0 to 4.5, has the same variation coefficient index of 18.8. Further, the inventive example 7 where "n" is set to 5.0, has a variation coefficient index of 21.2, and the inventive example 8 where "n" is set to 8.0, has a variation coefficient index of 20.0. As above, a significant improvement in the uniforming effect is observed at approximately the same level in each of the inventive examples.

Further, in each of the inventive example 4 ("n"=1.5) to the inventive example 8 ("n"=6.0), there is neither the negative-value region nor the reversal in a lower region of the discharge port.

As seen in the Example D, as long as the inner bore of the discharge port is gradually reduced in diameter in the direction from the start position to the end of the discharge port along a curved line satisfying the above formula having n=1.5 or more, or a combination of a plurality of curved lines each formed by setting "n" to a different value in the range of 1.5 or more, the significant molten-steel flow-uniforming effect of the present invention can be obtained.

When the angle is set in a downward direction as in the above inventive examples, the discharge port has a shape where an upper portion has a gentle curve and a lower portion has a relatively sharp curve, in the vicinity of the start position of the discharge port, as shown in FIGS. 6(*a*) to 6(*c*).

In view of the fact that the above result is obtained in this shape, the molten-steel flow-uniforming/straightening effect can be obtained as long as the configuration of the present invention is provided in upper and lower regions of a longitudinal cross-section passing through an axis of the discharge port extending in a molten-steel outflow direction.

Further, a portion on a lateral side of the discharge port is defined by the straight nozzle body of the immersion nozzle. This means that, in the above inventive examples, the configuration of the present invention is provided only in a refractory wall outward of an inner bore wall of the straight nozzle body of the immersion nozzle.

Example E

In the Example E, a fluid analysis based on the same computer simulation as that in the Examples A and B was carried out to check an influence of "Di/Do".

As conditions for the simulation, "n" was set to 4.0, and the molten-steel flow volume was set to 5 l/s (about 2.1 ton/min) as with the Example B. Further, the angle of the discharge port was set to 20 degrees in a downward direction, and "Di/Do" was changed in the range of 1.5 to 2.0.

A result of the simulation is shown in Table 5, and FIG. 19 and FIGS. 20 to 24 which are a graph for a comparative example 6 and graphs for inventive examples 9 to 12 (including the inventive example 2), respectively, wherein flow velocities are plotted with respect to the vertical position at the end of the discharge port (molten-steel discharge position).

TABLE 5

| | | Comparative example 6 | Inventive example 9 | Inventive example 10 |
|---|---|---|---|---|
| Conditions | Degree n | 4.0 | 4.0 | 4.0 |
| | Ratio Di/Do | 1.5 | 1.6 | 1.7 |
| | Discharge port angle (degree) | downward 20 | downward 20 | downward 20 |
| | Molten-steel flow volume (l/sec) | 5 | 5 | 5 |
| Result | Average flow velocity Ave | 0.59 | 0.65 | 0.63 |
| | Standard deviation σ | 0.310 | 0.164 | 0.149 |
| | Variation coefficient σ/Ave | 0.53 | 0.25 | 0.24 |
| | Variation coefficient index *1 | 62.4 | 29.4 | 28.2 |
| | Negative value (reverse flow) | Occurrence | Non | Non |
| | Reversal in heightwise direction | Non | Non | Non |
| | Comprehensive evaluation | X | ○ | ○ |
| | Corresponding figure (graph) | 19 | 20 | 21 |

| | | Inventive example 11 | Inventive example 12 | Inventive example 2 |
|---|---|---|---|---|
| Conditions | Degree n | 4.0 | 4.0 | 4.0 |
| | Ratio Di/Do | 1.8 | 1.9 | 2.0 |
| | Discharge port angle (degree) | downward 20 | downward 20 | downward 20 |
| | Molten-steel flow volume (l/sec) | 5 | 5 | 5 |
| Result | Average flow velocity Ave | 0.64 | 0.64 | 0.63 |
| | Standard deviation σ | 0.127 | 0.115 | 0.103 |
| | Variation coefficient σ/Ave | 0.20 | 0.18 | 0.16 |
| | Variation coefficient index *1 | #REF! | #REF! | #REF! |
| | Negative value (reverse flow) | Non | Non | Non |
| | Reversal in heightwise direction | Non | Non | Non |
| | Comprehensive evaluation | ○ | ○ | ○ |
| | Corresponding figure (graph) | 22 | 23 | 24 |

*1 with respect to comparative example 2: 100

As seen in this result, in the comparative example 6 where "Di/Do" is set to 1.5, on an assumption that the variation coefficient in the comparative example 2 is 100, the variation coefficient index is 62.6, which means that a significant improvement in the uniforming effect is not observed. Moreover, there is the negative-value region in an upper region of the discharge port although the reversal in a lower region of the discharge port is not observed.

In contrast, a significant uniforming effect can be obtained in each of the inventive examples, in view of the variation coefficient index on an assumption that the variation coefficient in the comparative example 2 is 100. Among them, the highest variation coefficient index of 29.4 is obtained when "Di/Do" is set to 1.6 (inventive example 9), and the lowest variation coefficient index of 18.8 is obtained when "Di/Do" is set to 2.0 (inventive example 2). As above, the variation coefficient index is apt to decrease as "Di/Do" is changed from 1.6 to 2.0.

Further, in each of the inventive example 9 ("Di/Do"=1.6) to the inventive example 12 ("Di/Do"=1.9) and the inventive step 2 ("Di/Do"=2.0), there is neither the negative-value region nor the reversal in a lower region of the discharge port.

The results of the above Examples can be summarized as follows.

As for "n", the molten-steel flow-uniforming/straightening effect can be obtained when "n" is set to 1.5 or more, and no deterioration in the effect is observed as long as "n" is 6.0 or less. Thus, the range of "n" for achieving the object of the present invention may be set to 1.5 or more. In this range, the highest effect can be obtained in the range of 2.0 to 4.5.

As for "Di/Do", the molten-steel flow-uniforming/straightening effect can be obtained when "Di/Do" is set to 1.6 or more, and no deterioration of the effect is observed (the effect is enhanced) as long as "Di/Do" is 2.0 or less. Thus, the range of "Di/Do" for achieving the object of the present invention may be set to 1.6 or more. In this range, the highest effect can be obtained at 2.0.

EXPLANATION OF CODES

1: immersion nozzle

What is claimed is:

1. An immersion nozzle comprising:

a tubular-shaped straight nozzle body formed to extend in a vertical longitudinal direction and adapted to allow molten steel from a molten-steel inlet provided at an upper end thereof to pass downwardly therethrough; and a pair of discharge ports provided in a lower portion of the straight nozzle body in bilaterally symmetrical relation and adapted to discharge the molten steel from a lateral surface of the straight nozzle body in a lateral direction, wherein an inner surface of each of the discharge ports has, at least in part or in its entirety, a shape defined by a curved line along which an inner bore of the discharge port in a longitudinal cross-section of the immersion nozzle passing through respective centers of the immersion nozzle and the discharge port is gradually reduced in diameter in a direction from a start position to an end of the discharge port, and wherein the curved line is represented by a diameter Dz in the longitudinal cross-section of the immersion nozzle in the following formula 1:

$$Dz = \left(\frac{H+L}{H+Z}\right)^{\frac{1}{n}} \times Do \quad (1)$$

where:

L is a wall thickness of the immersion nozzle;

Di is a diameter of the discharge port at the start position of the discharge port (a boundary position between the discharge port and an inner bore wall of the immersion nozzle; the same applies to the following formula 2);

Do is a diameter of the discharge port at the end of the discharge port (a boundary position between the discharge port and an outer peripheral wall of the immersion nozzle; the same applies to the following formula 2);

Z is a distance between the start position of the discharge port, and an arbitrary position apart from the start position toward the end of the discharge port;

Dz is a diameter of the discharge port at the position Z in the longitudinal cross-section of the immersion nozzle; and H is represented by the following formula 2, $$H = \frac{L}{\left\{\left(\frac{Di}{Do}\right)^{n} - 1\right\}}, \quad (2)$$

where $\frac{Di}{Do} \geq 1.6$, and $n \geq 1.5$.

2. The immersion nozzle as defined in claim 1, wherein each of the discharge ports has an angle in the longitudinal direction of the immersion nozzle, except an angle toward a direction perpendicular to a longitudinal axis of the immersion nozzle, and wherein the inner bore of the discharge port with the angle is configured such that a position of the discharge port corresponding to the distance Z in the longitudinal cross-section of the immersion nozzle is gradually shifted in a direction parallel to the longitudinal axis of the immersion nozzle by a longitudinal distance depending on the angle at the position corresponding to the distance Z.

3. An immersion nozzle comprising:

a tubular-shaped straight nozzle body formed to extend in a vertical longitudinal direction and adapted to allow molten steel from a molten-steel inlet provided at an upper end thereof to pass downwardly therethrough; and a pair of discharge ports provided in a lower portion of the straight nozzle body in bilaterally symmetrical relation and adapted to discharge the molten steel from a lateral surface of the straight nozzle body in a lateral direction, wherein an inner surface of each of the discharge ports has, at least in part or in its entirety, a shape defined by a combination of a plurality of curved lines along which an inner bore of the discharge port in a longitudinal cross-section of the immersion nozzle passing through respective centers of the immersion nozzle and the discharge port is gradually reduced in diameter in a direction from a start position to an end of the discharge port, and wherein each of the curved lines is configured to satisfy the formula 1 as defined in claim 1, while setting n in the formula 1 to a different value.

4. The immersion nozzle as defined in claim 3, wherein each of the discharge ports has an angle in the longitudinal direction of the immersion nozzle, except an angle toward a direction perpendicular to a longitudinal axis of the immersion nozzle, and wherein the inner bore of the discharge port with the angle is configured such that a position of the discharge port corresponding to the distance Z in the longitudinal cross-section of the immersion nozzle is gradually shifted in a direction parallel to the longitudinal axis of the immersion nozzle by a longitudinal distance depending on the angle at the position corresponding to the distance Z.

5. The immersion nozzle as defined in claim 1, wherein $1.5 \leqq n \leqq 6.0$.

6. The immersion nozzle as defined in claim 5, wherein $2.0 \leqq n \leqq 4.5$.

7. The immersion nozzle as defined in claim 1, wherein $$\frac{Di}{Do} \leq 2.0.$$

8. The immersion nozzle as defined in claim 5, wherein $$\frac{Di}{Do} \leq 2.0.$$

9. The immersion nozzle as defined in claim 6, wherein $$\frac{Di}{Do} \leq 2.0.$$

* * * * *